US007308817B2

(12) United States Patent
Shimota et al.

(10) Patent No.: US 7,308,817 B2
(45) Date of Patent: Dec. 18, 2007

(54) PUSH PLATE TOOL HOLDER FOR PRESS BRAKES

(75) Inventors: Jon M. Shimota, Stillwater, MN (US); Terry G. Pabich, Roberts, WI (US); Ronald G. Rosene, Coon Rapids, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 387 days.

(21) Appl. No.: 11/053,134

(22) Filed: Feb. 8, 2005

(65) Prior Publication Data

US 2006/0174680 A1 Aug. 10, 2006

(51) Int. Cl.
*B21D 37/00* (2006.01)

(52) U.S. Cl. ..... 72/482.1; 72/481.1

(58) Field of Classification Search ..... 72/389.3, 72/389.4, 389.6, 481.1, 481.2; 279/76, 87, 279/89, 94

See application file for complete search history.

(56) References Cited

U.S. PATENT DOCUMENTS 4,315,425 A * 2/1982 Zbornik et al. ..... 72/481.2
4,506,538 A 3/1985 Jones, Jr.
4,612,796 A 9/1986 Smyth, Jr.
4,721,293 A 1/1988 Schron et al.
4,993,255 A 2/1991 Treillet
5,022,256 A 6/1991 van der Meulen
5,065,610 A 11/1991 Yonezawa
5,245,854 A 9/1993 Bruggink et al. ..... 72/481
5,511,407 A * 4/1996 Kawano ..... 72/482.91
5,513,514 A 5/1996 Kawano
5,562,892 A 10/1996 Kirk et al.
5,572,902 A 11/1996 Kawano
5,642,642 A 7/1997 Kawano
5,685,149 A 11/1997 Schneider et al.
5,720,169 A 2/1998 Schneider et al.
5,782,308 A * 7/1998 Latten et al. ..... 72/481.6
5,822,989 A 10/1998 Sturdevant et al.

(Continued)

FOREIGN PATENT DOCUMENTS

DE 41 15 224 A1 11/1992

(Continued)

OTHER PUBLICATIONS

"New Standard Clamping" www.wila.nl, printed Mar. 3, 2005 (four pages from www.wila.nl/English/clamping/ProductInfo_NS.htm; one page from www.wila.nl/images/dia-8-eng.gif; one page from www.wila.nl/images/dia-4-eng.gif; one page from www.wila.nl/images/dia-5-eng/gif; one page from www.wila.nl/images/diz-17-eng.gif, and four previously printed pages ("New Standard") from www.wila.nl.

(Continued)

*Primary Examiner*—Derris H. Banks
*Assistant Examiner*—Teresa M. Bonk
(74) *Attorney, Agent, or Firm*—Fredrikson & Byron, P.A.

(57) ABSTRACT

Press brake tool holders suitable for releasing and securing press brake tools are provided. Provided in certain embodiments are a press brake tool holder and press brake tool, in combination. Methods of using press brake tool holders as well as press brake tool holders and press brake tools are also provided.

67 Claims, 14 Drawing Sheets

U.S. PATENT DOCUMENTS

| | | | | |
|---|---|---|---|---|
| 6,000,273 | A | 12/1999 | Stover | |
| 6,003,360 | A | 12/1999 | Runk et al. | |
| 6,109,602 | A | 8/2000 | Schron et al. | |
| 6,151,951 | A * | 11/2000 | Kawano | 72/481.2 |
| 6,241,231 | B1 | 6/2001 | Schron et al. | |
| 6,446,485 | B1 | 9/2002 | Tarasconi | |
| 6,450,004 | B1 | 9/2002 | Edmondson | |
| 6,467,327 | B1 | 10/2002 | Runk et al. | |
| 6,481,204 | B1 | 11/2002 | Yuschak et al. | |
| 6,522,953 | B1 | 2/2003 | Schneider et al. | |
| 6,564,611 | B2 | 5/2003 | Harrington et al. | |
| 6,644,090 | B2 * | 11/2003 | Gasparini | 72/482.2 |
| 6,848,291 | B1 | 2/2005 | Johnson | |
| 6,928,852 | B2 * | 8/2005 | Enderink | 72/481.1 |
| 7,021,116 | B2 | 4/2006 | Harrington | |
| 7,096,708 | B2 * | 8/2006 | Gascoin | 72/482.91 |
| 2002/0023477 | A1 | 2/2002 | Gianelli | |
| 2004/0163442 | A1 | 8/2004 | Gascoin | |
| 2004/0187552 | A1 | 9/2004 | Enderink | |

FOREIGN PATENT DOCUMENTS

| | | |
|---|---|---|
| DE | 19845386 | 5/2000 |
| EP | 0 494 714 A1 | 7/1992 |
| EP | 0 644 002 A2 | 3/1995 |
| EP | 1493506 | 1/2005 |
| FR | 2122977 | 1/1972 |
| JP | 10-323720 | 12/1998 |
| JP | 2003 191016 | 7/2003 |
| JP | 2003 200219 | 7/2003 |
| WO | WO 2002/092253 | 11/2002 |
| WO | WO 2004/024361 | 3/2004 |
| WO | WO 2004/101188 | 11/2004 |

OTHER PUBLICATIONS

TCAM T-Vise Operator's Manual, TCAM Power Workholding, LLC., publ. 2001.
Wila Press Brake Productivity Guide, 2005/06, 217 pages.

* cited by examiner

PUSH PLATE TOOL HOLDER FOR PRESS BRAKES

FIELD OF THE INVENTION

The present invention relates generally to industrial presses. More particularly, this invention relates to press brakes.

BACKGROUND OF THE INVENTION

Press brakes are commonly used to bend or otherwise deform sheet-like workpieces, such as sheet metal workpieces. A conventional press brake has an upper beam and a lower beam, at least one of which is movable toward and away from the other. Typically, the upper beam is movable vertically while the lower beam is fixed in a stationary position. It is common for a male forming punch and a female forming die to be mounted respectively on the upper and lower beams of a press brake.

Typically, the punch has a downwardly-oriented, workpiece-deforming surface (or "tip"). The configuration of this surface is dictated by the shape into which it is desired to deform a workpiece. The die typically has a recess, bounded by one or more workpiece-deforming surfaces, that is aligned with the tip of the punch. The configuration of this recess corresponds to the configuration of the punch's tip. Thus, when the beams are brought together, a workpiece between them is pressed by the punch into the die to give the workpiece a desired deformation (e.g., a desired bend).

From time to time, it is necessary to exchange punches and dies to accommodate different bending operations. The manner in which punches and dies are mounted on, and dismounted from, a press brake depends upon the type of tool holder being used. A variety of press brake tool holders have been devised with the goal of facilitating easy mounting and dismounting of forming tools. Exemplary tool holders will now be described.

U.S. Pat. No. 4,993,255 (issued to Treillet), the entire contents of which are incorporated herein by reference, discloses a tool holder that is attached by means of a C clamp to the bed of the upper table. Through use of a camming mechanism, the upwardly extending shank of a tool is captured between a pivotable clamp and a portion of the holder, the shank and clamp having cooperating surfaces enabling the tool to be readily inserted in the holder. In this patent, a locking cam is disclosed for locking the clamp against the tool.

U.S. Pat. Nos. 5,513,514, 5,511,407, and 5,572,902 (each issued to Kawano), and European patent publication 0 644 002 A2, the entire contents of each of which are incorporated herein by reference, all show tool holders in which a pivoting clamp is employed to secure the shank of a tool against the mounting plate of a tool holder. In these patents, the tool holder is equipped with a threaded mechanism operated by a lever that pivots from side to side to lock and unlock the clamp, force being transmitted from the lever to the clamp via a spring structure.

U.S. Pat. No. 6,003,360 (issued to Runk et al.) provides a particularly advantageous press brake tool holder. The tool holder includes a clamp that opens to a position allowing manual removal of the tool while preventing the tool from falling. The clamp in certain preferred embodiments is actuated with a manual lever. The entire contents of this '360 Runk patent are incorporated herein by reference.

U.S. Pat. No. 6,151,951 (issued to Kawano), the entire contents of which are incorporated herein by reference, discloses a tool holder having multiple hydraulically actuated pistons that transmit force generated by hydraulic fluid to a clamp. The pistons are displaced outwardly to force the clamp shut.

U.S. Pat. No. 6,564,611 (issued to Harrington et al.) discloses various hydraulic press brake tool holders. The press brake tool holders are configured for releasing and securing tools in response to applied fluid pressure. One disclosed tool holder embodiment includes a horizontally-elongated body having a longitudinal bore in which a cam shaft is slidably received. The cam shaft can have at least one axial camming surface, with a large outer diameter region axially tapered to a small outer diameter region. The shaft can be operably coupled with a cam follower pin slidably received in a bore extending transversely through the body. The cam follower pin can bear against a pivotally mounted clamp disposed about the body. In response to applied fluid pressure, the camming surface can slide axially, thereby increasing the effective outer diameter as seen by the cam follower pin, urging the cam follower pin outward and against the upper portion of the pivotally mounted clamp, thereby forcing the lower clamp portion to close upon the tang of a press brake tool. The entire contents of this Harrington '611 patent are incorporated herein by reference.

U.S. patent application publication 2004/0187552A1 (Enderlink) discloses a press brake clamping system in which a moveable horizontal pin can be clamped forcibly against the tang of a press brake tool. The pin has an end surface that is partially slanted. By operating a bellow, the pin can be moved so that its partially slanted end surface contacts, and coacts with, the tang of the tool so as to lift the tool upwardly into the tool holder.

The present invention provides a new press brake tool holder, which overcomes limitations of common press brake tool holders. In some particularly advantageous embodiments, the tool holder is suitable for hydraulic control.

SUMMARY OF THE INVENTION

In certain embodiments, the invention provides a tool holder for a press brake. The tool holder has a tool-mount channel configured for receiving a tang of a press brake tool. In the present embodiments, the tool holder comprises a driver and a push plate to which the driver is operably coupled. In the present embodiments, the push plate is mounted on the tool holder so as to be moveable between a first configuration and a second configuration, and the driver is adapted for being operated so as to move the push plate from its first configuration to its second configuration. The tool holder of the present embodiments also comprises a pusher member mounted on the tool holder so as to be moveable between an open position and a closed position. In the present embodiments, a desired end region of the pusher member extends into the tool-mount channel when the pusher member is in its closed position, and the pusher member is operably coupled with the push plate such that when the push plate is in its first configuration the pusher member is in its closed position and the push plate provides resistance against the pusher member being moved into its open position. In some of the present embodiments, the push plate has an anchored side and a free side, the anchored side is rigidly secured to the tool holder, and the push plate is mounted on the tool holder so as to be moveable from its first configuration to its second configuration by a bending of the push plate in which the free side of the push plate moves generally away from the tool holder (and/or generally away from the tool-mount channel). In some of the present embodiments, the tool holder is adapted for moving the tool along a pressing axis during a pressing operation, and the push plate is mounted rigidly on the tool holder such that the push plate is prevented from moving substantially in a direction parallel to the pressing axis. For example, the push plate can optionally be mounted rigidly on the tool holder such that the push plate is prevented from moving substantially in a vertical direction. In some of the present embodiments, the driver has an energized state and a non-energized state, and when the driver is in its non-energized state the push plate is in its first configuration and bears forcibly against the pusher member. In some of the present embodiments, the tool holder has generally-opposed front and rear sides, the push plate is mounted on one side of the tool holder, and the driver is a hydraulic driver comprising a hydraulic assembly that includes a hydraulic line extending from the other side of the tool holder. In some of the present embodiments, the push plate is mounted on the tool holder such that the push plate is carried alongside a block of the tool holder, the block defines two generally-planar surfaces lying in respective planes that are separated by a desired acute angle, and the push plate is carried alongside these two surfaces of the block and defines two generally-planar surfaces lying in respective planes that are separated by an angle not more than about five degrees different than the noted acute angle. For example, a first of these two generally-planar surfaces can optionally be generally vertical, while a second of these two surfaces can be slanted at the noted acute angle relative to the first of these two surfaces. In some of the present embodiments, the push plate includes a plurality of force-delivery fingers and a plurality of slits, each slit extends entirely through a thickness of the push plate and is bounded by two of the force-delivery fingers, the push plate has an anchored side and a free side, the anchored side is rigidly secured to the tool holder, the free side has the force-delivery fingers, and when the push plate is in its first configuration one of the force-delivery fingers bears forcibly against the pusher member. In some embodiments of this nature, the push plate has a mount portion and a base portion, the mount portion is rigidly secured to a block of the tool holder, the base portion defines the force-delivery fingers, the slits do not extend into the mount portion, and the mount portion, the base portion, and the force-delivery fingers are defined by one integral body. Here, the mount portion of the push plate can optionally lie in a different plane than the base portion of the push plate. In some of the present embodiments, the push plate has an anchored side and a free side, the anchored side is rigidly secured to a block of the tool holder, there is a gap between the free side of the push plate and the block of the tool holder and this gap has a lesser width when the push plate is in its first configuration than when the push plate is in its second configuration. In some embodiments of this nature, the free side of the push plate bears forcibly against the pusher member when the push plate is in its first configuration. In some of the present embodiments, the pusher member comprises a rigid body mounted slidably in a bore extending through a block of the tool holder, this bore extends along a bore axis that is generally perpendicular to a pressing axis along which the tool holder is adapted for moving the tool during a pressing operation, and this rigid body is mounted slidably in this bore so as to be slidably moveable along the bore axis. In some of the present embodiments, the tool holder is adapted, when the tool is operatively mounted in the channel, for moving the tool along a pressing axis during a pressing operation, and the pusher member is adapted for delivering to such an operatively-mounted tool a force having both a seating component and a clamping component, the seating component is generally parallel to the pressing axis, and the clamping component is generally perpendicular to the pressing axis. In some of the present embodiments, the push plate includes a plurality of force-delivery fingers and a plurality of slits, each slit extends entirely through a thickness of the push plate and is bounded by two of the force-delivery fingers, one of the force-delivery fingers is adapted for delivering force to the pusher member, a second of the force-delivery fingers is adapted for delivering force to a second pusher member, the second pusher member is mounted on the tool holder for movement between an unlocked position and a locked position, a desired end region of the second pusher member extends into the tool-mount channel when the second pusher member is in its locked position, and the second pusher member is operably coupled with the push plate such that when the push plate is in its first configuration the second pusher member is in its locked position and the push plate provides resistance against the second pusher member being moved into its unlocked position. In some of the present embodiments, the driver comprises a hydraulic assembly including a hydraulic chamber and at least one moveable wall disposed in a recess defined by a block of the tool holder, this wall optionally is moveable in response to delivering hydraulic fluid into the hydraulic chamber.

In certain embodiments, the invention provides a press brake tool holder and a press brake tool, in combination. Here, the tool holder has a tool-mount channel in which a tang of the tool is received. In the present embodiments, the tool holder comprises: (a) a driver; (b) a push plate to which the driver is operably coupled, the push plate is mounted on the tool holder so as to be moveable between a first configuration and a second configuration, the push plate is in its first configuration, and the driver is adapted for being operated so as to move the push plate from its first configuration to its second configuration; (c) a pusher member mounted on the tool holder so as to be moveable between an open position and a closed position, the pusher member is in its closed position and a desired end region of the pusher member bears forcibly against the tang of the tool, the pusher member is operably coupled with the push plate such that the push plate provides resistance against moving the pusher member into its open position. In some of the present embodiments, the tool holder is adapted for moving the tool along a pressing axis, the pusher member bears against an engagement portion of the tool's tang so as to deliver to the tool a force, at least one of the desired end region of the pusher member and the engagement portion of tool's tang comprises a tapered surface, the noted force has both a seating component and a clamping component, the seating component is generally parallel to the pressing axis, and the clamping component is generally perpendicular to the pressing axis. In such embodiments, the clamping component can optionally be a generally horizontal force component, and the seating component can optionally be a generally vertical force component. In some of the present embodiments, the driver has an energized state and a non-energized state, and when the driver is in its non-energized state the push plate is in its first configuration and bears forcibly against the pusher member. In some of the present embodiments, the tool holder has generally-opposed front and rear sides, the push plate is mounted on one side of the tool holder, and the driver is a hydraulic driver comprising a hydraulic assembly that includes a hydraulic line extending from the other side of the tool holder. In some of the present embodiments, the push plate includes a plurality of force-delivery fingers and a plurality of slits, each slit extends entirely through a thickness of the push plate and is bounded by two of the force-delivery fingers. In some embodiments of this nature, the push plate has an anchored side and a free side, the anchored side is rigidly secured to the tool holder, the free side has the force-delivery fingers, and one of the force-delivery fingers bears forcibly against the pusher member. Optionally, such a push plate has a mount portion and a base portion, the mount portion is rigidly secured to a block of the tool holder, the base portion defines the force-delivery fingers, the slits do not extend into the mount portion, and the mount portion, the base portion, and the force-delivery fingers are defined by one integral body. In some of the present embodiments, the push plate is mounted on the tool holder so as to be moveable from its first configuration to its second configuration by a bending of the push plate. In some of the present embodiments, the push plate has an anchored side and a free side, the anchored side is rigidly secured to the tool holder, and when the driver is operated so as to move the push plate from its first configuration to its second configuration the free side of the push plate moves generally away from the tool-mount channel. In some of the present embodiments, the push plate comprises a resilient metal plate. In some of the present embodiments, the pusher member has a generally-cylindrical configuration with at least one planar side surface. In some of the present embodiments, the push plate has an anchored side and a free side, the anchored side is rigidly secured to a block of the tool holder, there is a gap between the free side of the push plate and the block of the tool holder, and this gap has a lesser width than when the push plate is in its second configuration. In some of the present embodiments, the push plate includes a plurality of force-delivery fingers and a plurality of slits, each slit extends entirely through a thickness of the push plate and is bounded by two of the force-delivery fingers, one of the force-delivery fingers bears forcibly against the pusher member, and a second of the force-delivery fingers bears forcibly against a second pusher member, the second pusher member is mounted on the tool holder for movement between an unlocked position and a locked position, the second pusher member is in its locked position and a desired end region of the second pusher member bears forcibly against the tang of the tool. In some of the present embodiments, the pusher member comprises a rigid body mounted slidably in a bore extending through a block of the tool holder, and this bore extends in a direction that is generally perpendicular to a pressing axis along which the tool holder is adapted for moving the tool during a pressing operation.

In certain embodiments of the invention, there is provided a method of operating a press brake. In the present embodiments, the method comprises: (a) providing a press brake tool holder and a press brake tool, in combination, the tool holder having a tool-mount channel in which a tang of the tool is received and forcibly clamped. In the present method, the tool holder comprises: (i) a driver; (ii) a push plate to which the driver is operably coupled, the push plate is mounted on the tool holder so as to be moveable between a first configuration and a second configuration, the push plate is in its first configuration, the driver is adapted for being operated so as to move the push plate from its first configuration to its second configuration by bending the push plate; (iii) a pusher member mounted on the tool holder so as to be moveable between an open position and a closed position, wherein the pusher member is in its closed position and a desired end region of the pusher member bears forcibly against the tang of the tool so as to deliver a clamping force to the tool, the pusher member is operably coupled with the push plate such that the push plate bears forcibly upon the pusher member and provides resistance against moving the pusher member into its open position. In the present embodiments, the method comprises operating the driver so as to move the push plate from its first configuration to its second configuration, thereby bending the push plate, thus eliminating or reducing the clamping force. In some of the present embodiments, the push plate has an anchored side and a free side, the anchored side is rigidly secured to the tool holder, and operating the driver causes the push plate to bend from its first configuration to its second configuration such that the free side of the push plate moves generally away from the tool-mount channel. In some of the present embodiments, the tool holder is adapted for moving the tool along a pressing axis during a pressing operation, the push plate is mounted rigidly on the tool holder such that the noted movement of the push plate from its first configuration to its second configuration involves substantially no movement of the push plate in a direction parallel to the pressing axis. In some of the present embodiments, the noted movement of the push plate from its first configuration to its second configuration involves substantially no vertical movement of the push plate. In some of the present embodiments, the driver is a hydraulic driver, and the noted operation of the driver involves delivering hydraulic fluid into a chamber of the driver. For example, this hydraulic fluid can optionally be delivered into the chamber at a pressure between about 2,000 psi and about 5,000 psi. In some of the present embodiments, the noted movement of the push plate from its first configuration to its second configuration results in the pusher member moving from its closed position to its open position. In some embodiments of this nature, the pusher member comprises a rigid body mounted slidably in a bore extending through a block of the tool holder, this bore extends along a bore axis that is generally perpendicular to a pressing axis along which the tool holder is adapted for moving the tool during a pressing operation, and the noted movement of the pusher member from its closed position to its open position involves the rigid body sliding within the bore along the bore axis. In some of the present embodiments, the push plate has an anchored side and a free side, the anchored side is rigidly secured to a block of the tool holder, there was a gap between the free side of the push plate and the block when the push plate was in its first configuration, and the noted movement of the push plate involved the free side of the push plate moving further away from the block. In some of the present embodiments, the push plate includes a plurality of force-delivery fingers and a plurality of slits, each slit extends entirely through a thickness of the push plate and is bounded by two of the force-delivery fingers, the push plate has a mount portion and a base portion, the mount portion is rigidly secured to a block of the tool holder, the base portion defines the force-delivery fingers, the slits do not extend into the mount portion, and the mount portion, the base portion, and the force-delivery fingers are defined by one integral body.

In certain embodiments, the invention provides a method of operating a press brake. In the present embodiments, the method comprises providing a press brake tool holder and a press brake tool, in combination. Here, the tool holder has a tool-mount channel in which a tang of the tool is received and forcibly clamped. In the present embodiments, the tool holder comprises: (i) a driver that is hydraulic and includes a hydraulic chamber; (ii) a push plate to which the driver is operably coupled, the push plate is moveable between a first configuration and a second configuration, the push plate is in its first configuration, the driver is adapted for being operated in response to delivering hydraulic fluid into the hydraulic chamber, and the driver can be operated in this manner so as to move the push plate from its first configuration to its second configuration; (iii) a pusher member that is moveable between an open position and a closed position, the pusher member is in its closed position and bears forcibly against the tool so as to deliver a clamping force to the tool, the pusher member is operably coupled with the push plate such that the push plate bears forcibly upon the pusher member and provides resistance against moving the pusher member into its open position. In the present embodiments, the method comprises delivering hydraulic fluid at a pressure of between about 2,000 psi and about 5,000 psi into the hydraulic chamber, thereby operating the driver so as to move the push plate from its first configuration to its second configuration, thus eliminating or reducing the clamping force.

DETAILED DESCRIPTION OF PREFERRED EMBODIMENTS

Figure 1:
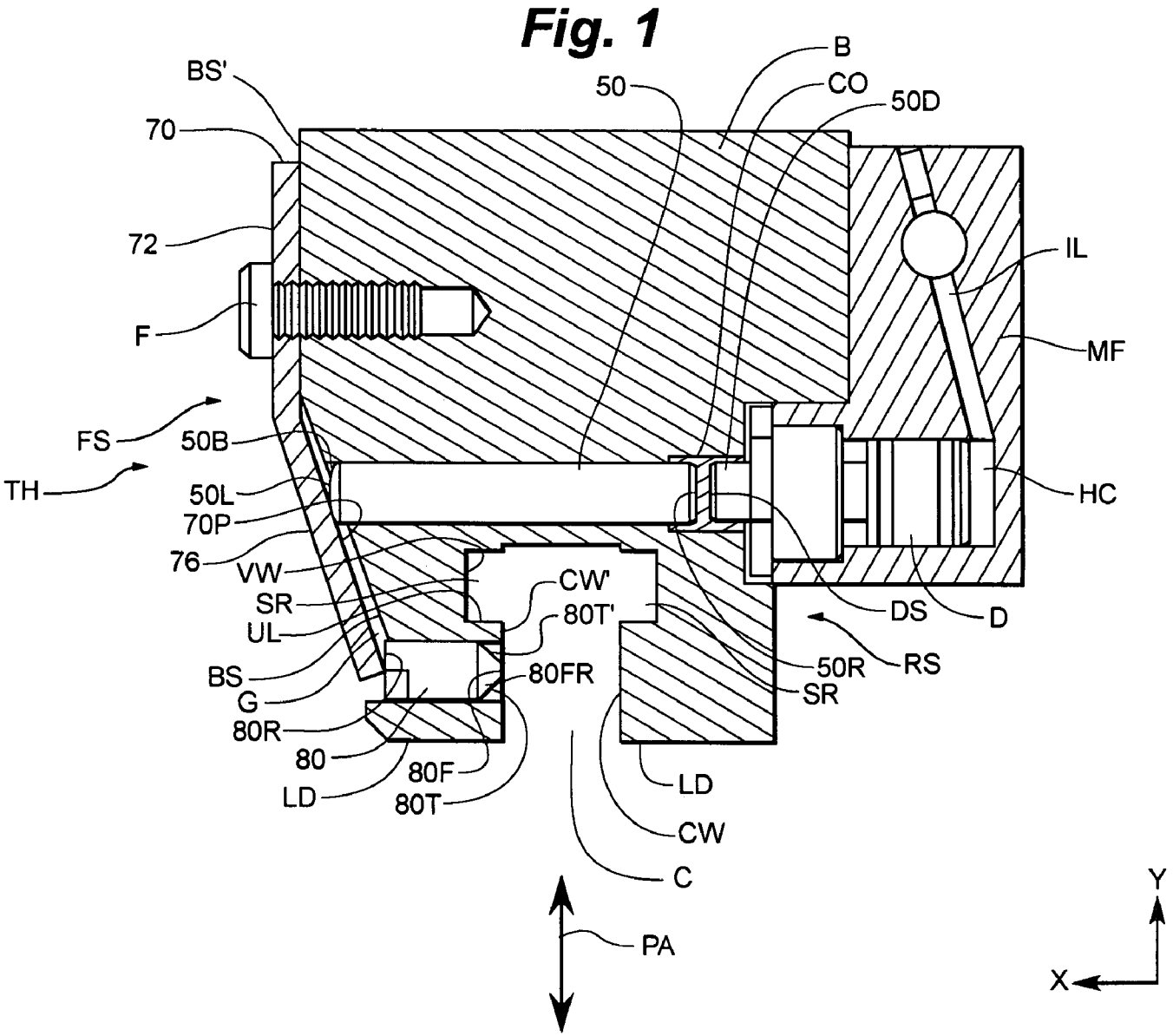
FIG. 1 is a schematic cross-sectional side view of a press brake tool holder in accordance with certain embodiments of the present invention.

FIG. 1 is a schematic cross-sectional side view of a brake press tool holder in accordance with certain embodiments of the present invention. Generally, the tool holder TH defines a channel C configured for receiving the tang T of a press brake tool TL. This channel C is referred to herein as the tool-mount channel. In some embodiments, the tool-mount channel C has a generally T-shaped cross section, although this is by no means required. Preferably, the channel C is bounded by two confronting walls CW, CW' of the tool holder. In the illustrated embodiments, the confronting walls CW, CW' are generally or substantially vertical (and preferably define surfaces that are generally or substantially vertical and planar). These features, however, are not required in all embodiments. Rather, the configuration of the wall(s) bounding the tool-mount channel C will vary depending upon the particular style in which the invention is embodied.

The tool holder will commonly be of the American style. However, the tool holder can take the form of various other press brake tool holder styles known in the art, including those currently in less widespread use. In fact, it will be appreciated that the tool holder TH can reflect any desired tooling style, including styles not yet developed, that would benefit from the features of this invention. The tool holder, of course, can be a press brake beam, an adaptor mounted to a press brake beam, or any other type of press brake tool holder.

Certain embodiments of the invention provide a press brake tool holder in combination with a press brake tool. The tool TL can be a male forming punch or a female forming die. Typically, the tool TL has generally opposed first and second ends (or sides). Preferably, the first end (or side) of the tool defines a workpiece-deforming surface TP (e.g., at a tip of the tool) configured for making a desired deformation (e.g., a bend) in a workpiece when this surface TP is forced against the workpiece (e.g., when a tip of the tool is forced against a piece of sheet metal or the like). The second end (or side) of the tool has a tang T that is configured for being mounted in the tool-mount channel C, as will now be described.

The tang T of the tool TL is sized and shaped to be received in the tool-mount channel C. Preferably, a clearance gap CG is provided to facilitate mounting and dismounting the tang T in the channel C. This is best appreciated with reference to FIG. 12. Here, it can be seen that a lateral width (i.e., the width along the x axis) of the channel C is slightly greater than a corresponding lateral width of the tang T. Preferably, the clearance gap is less than about 0.1 inch, and more preferably is less than about 0.05 inch, such as about 0.01 inch.

Figure 3:
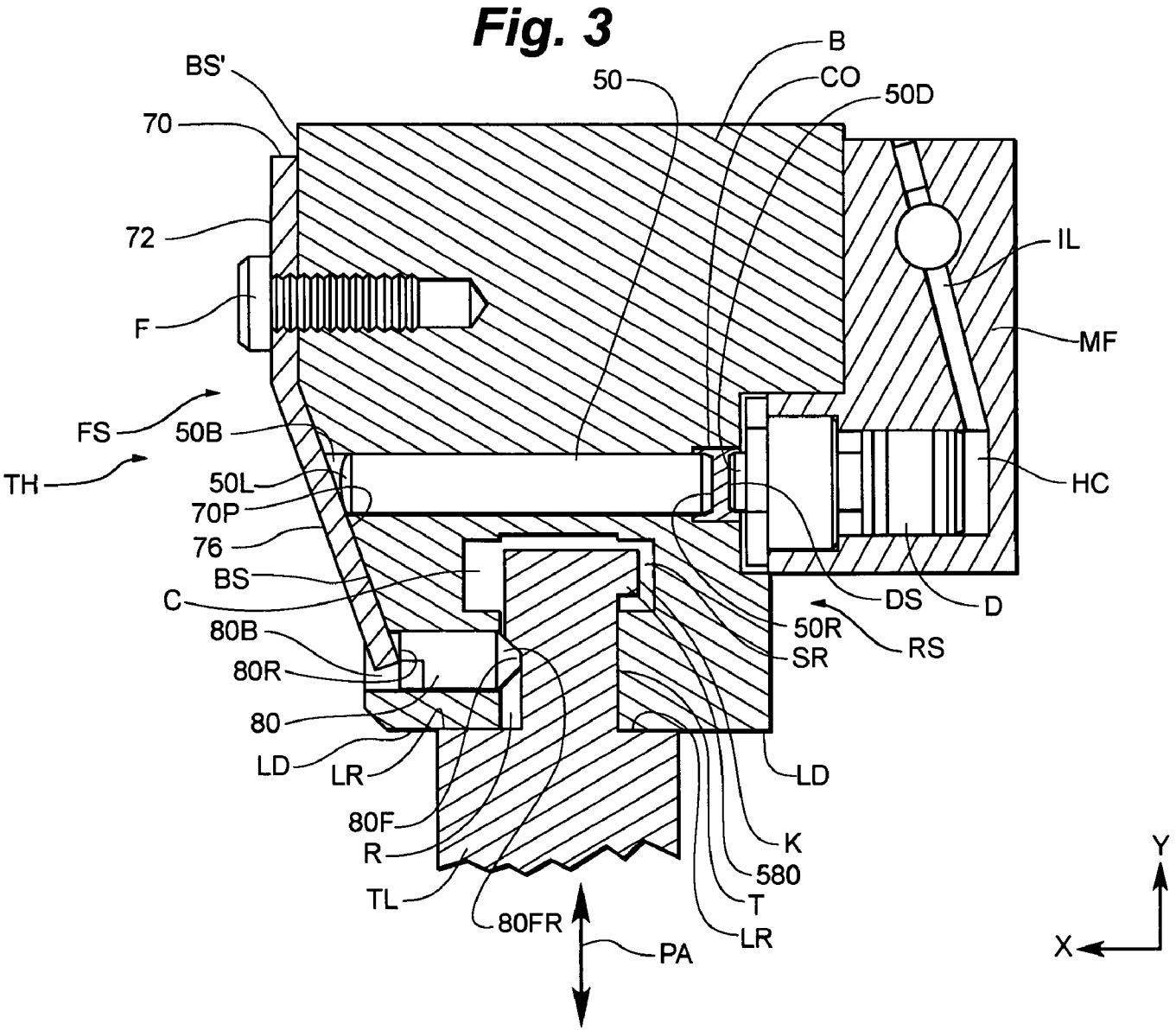
FIG. 3 is a schematic cross-sectional side view of a press brake tool holder in combination with a press brake tool in accordance with certain embodiments of the invention.
Figure 4:
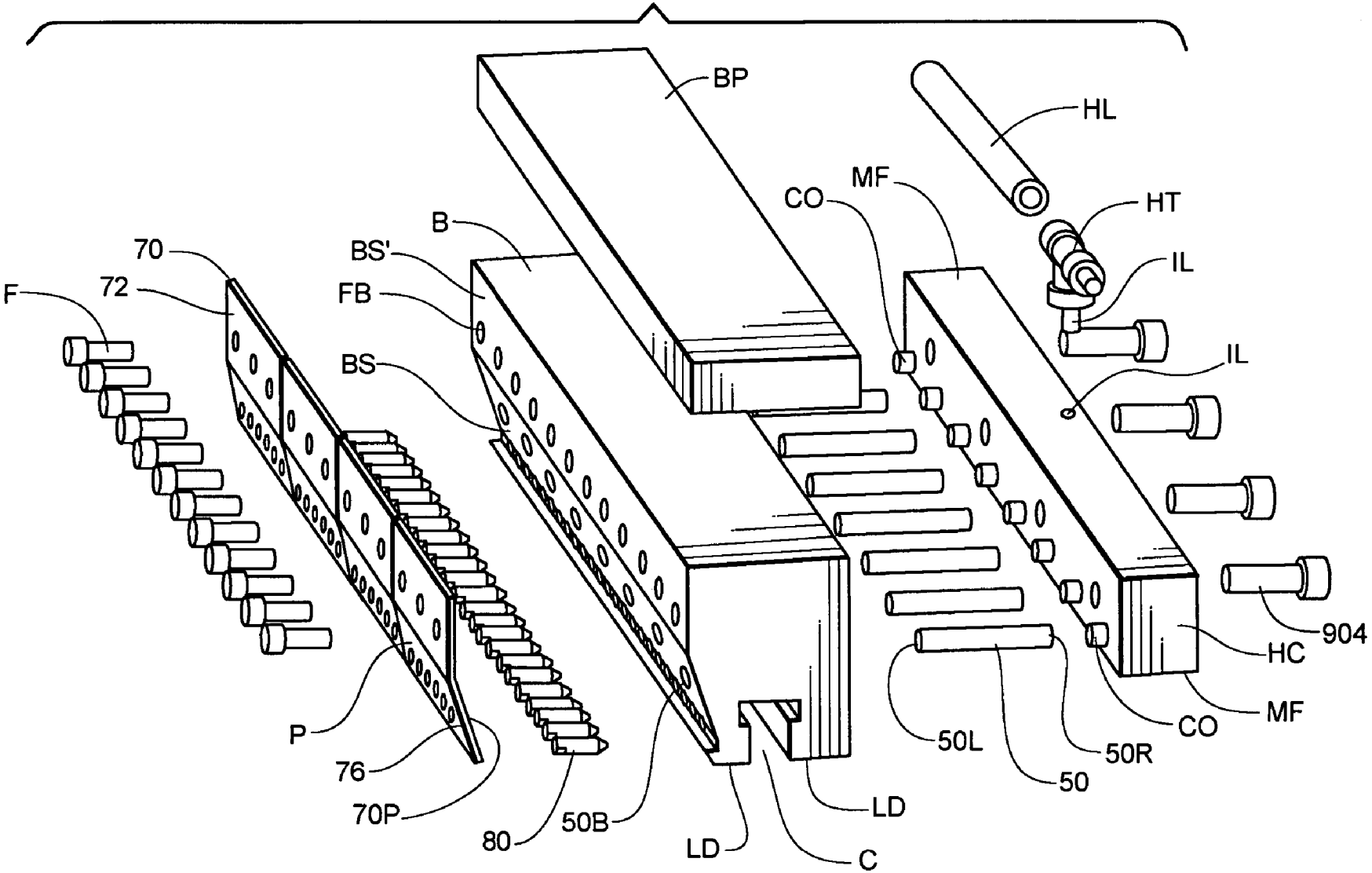
FIG. 4 is an exploded, perspective view of a press brake tool holder in accordance with certain embodiments of the invention.
Figure 5:
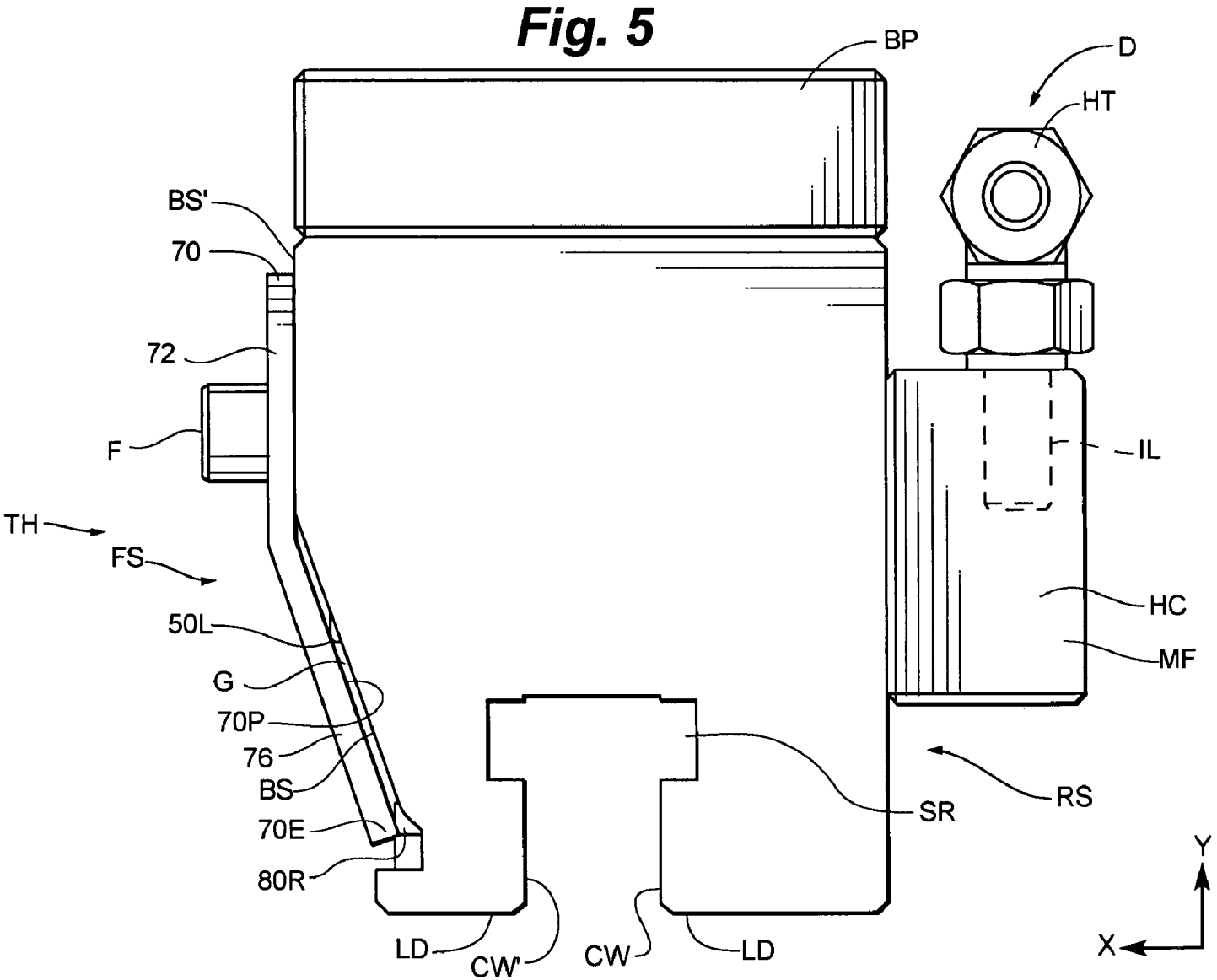
FIG. 5 is a schematic side view of a press brake tool holder in accordance with certain embodiments of the invention.
Figure 11:
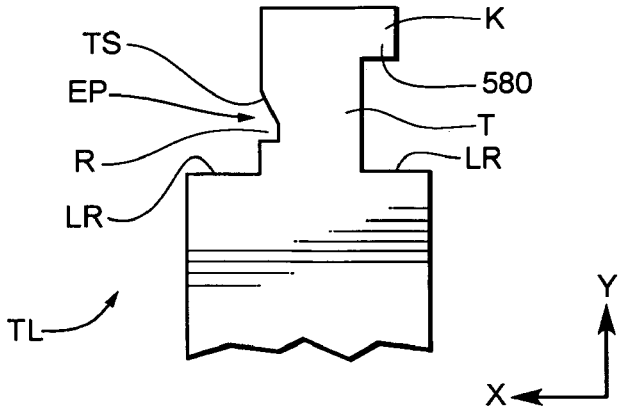
FIG. 11 is a partially broken-away side view of a press brake tool that is provided in certain embodiments of the invention.

In some cases, the tool TL has a safety key K. As shown in FIGS. 3 and 11, the tang T of the tool TL can optionally have a safety key K adapted for engaging a safety recess (or "safety groove") SR defined by the tool holder TH. When provided, the safety key K can be retractable or non-retractable. Safety keys of both types are described in U.S. Pat. No. 6,467,327 (Runk et al.), and U.S. patent application Ser. No. 10/742,439, entitled "Press Brake Tooling Technology", the entire contents of each of which are incorporated herein by reference.

In embodiments involving a tool TL with a safety key K, the key K preferably comprises an engagement portion 580 that is adapted to project into a safety recess SR defined by the tool holder TH. In the case of a non-retractable safety key, the key will typically comprise a rigid projection from the tool's tang. When provided, the non-retractable safety key preferably is either integral to the tool's tang or rigidly joined to the tool's tang.

In the case of a retractable safety key K, the key is mounted on the tool TL so as to be moveable between an extended position and a retracted position. In more detail, such a key K preferably comprises a rigid engagement portion 580 that is moveable relative to (e.g., generally toward and away from) the tool's tang. Such retractable safety keys are described in U.S. Pat. No. 6,467,327 and U.S. patent application Ser. No. 10/742,439. In some cases, the safety key is part of a key assembly (e.g., mounted inside and/or on the tool) comprising at least one spring resiliently biasing the key toward its extended position. Various assemblies of this nature can be used.

Thus, in some embodiments, the tool holder defines a safety recess SR. When provided, the safety recess SR preferably is sized to receive an engagement portion 580 of a desired safety key K. In some embodiments involving the tool holder TH in combination with a press brake tool TL, the tool holder TH has a safety recess SR at a location on the tool holder TH that is aligned with (e.g., is at the same elevation as) a safety key K on the tool TL. For example, some embodiments of this nature (such as that shown in FIG. 3) provide a tool TL having a safety key K projecting away from a tang T of the tool and engaged with (e.g., extending into) a safety recess SR defined by the tool holder, such that an engagement portion 580 of the safety key is received by the safety recess SR.

Figure 12:
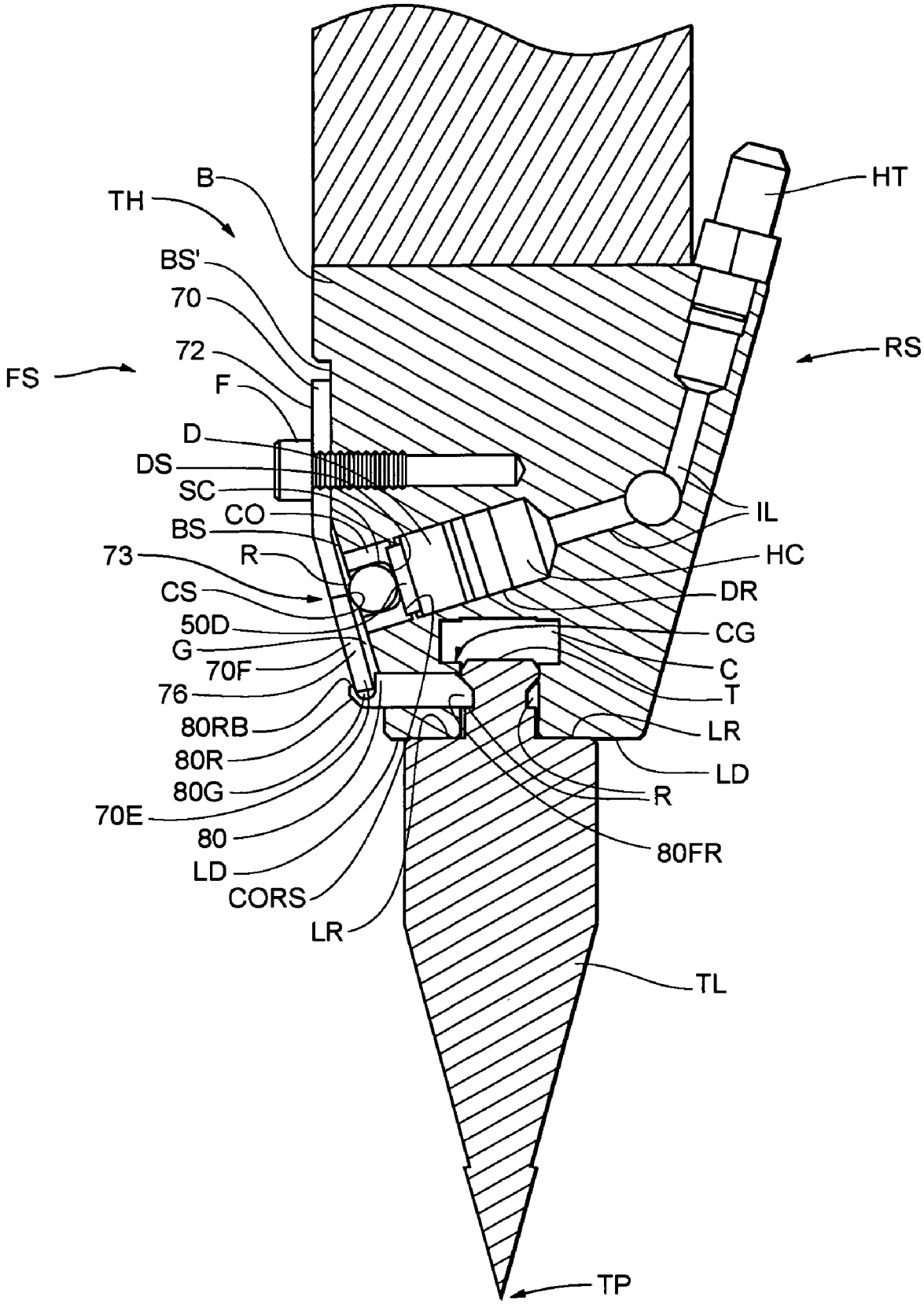
FIG. 12 is a schematic cross-sectional side view of a press brake tool holder in combination with a press brake tool in accordance with certain embodiments of the invention.

Thus, certain embodiments of the invention provide a tool holder and a tool in combination. Reference is made to FIGS. 3 and 12. In these combination embodiments, the second end of the tool TL has a tang T that is received in the tool holder's channel. As noted above, the channel C is typically bounded by two confronting walls CW, CW' of the tool holder. In the present combination embodiments, the tool's first end (which typically defines a tip) preferably projects (e.g., generally vertically) away from the tool holder.

Typically, the tool holder TH has at least one load-delivering surface LD configured for engaging a load-receiving surface LR of a press brake tool TL. Preferably, the tool holder TH has one or more generally or substantially horizontal load-delivering surfaces LD each being adapted to engage and deliver force to (when the tool is operatively mounted on the tool holder) one or more corresponding generally or substantially horizontal load-receiving surfaces LR of the tool TL. In some embodiments involving a tool in combination with a tool holder, the tool holder has a load-delivering surface LD engaged with (e.g., carried directly against) a load-receiving surface LR of the tool TL. Preferably, these engaged surfaces LD and LR are generally or substantially horizontal. In some cases, the tool holder TH has two horizontal load-delivering surfaces LD. For example, FIGS. 1-8 and 12-14 depict tool holders of this nature, wherein two load-delivering surfaces LD are separated by an opening of the tool-mount channel C. Here, the channel C is depicted as being downwardly open. However, the invention also provides embodiments wherein the channel C is upwardly open (e.g., embodiments wherein the tool holder is used to secure a die on the lower beam of a press brake).

The illustrated load-delivering surfaces LD are configured for engaging, and delivering force to, corresponding load-receiving surfaces LR of a tool TL. Thus, surfaces LD and LR are load-bearing surfaces. In FIGS. 3 and 12, the horizontal load-delivering surfaces LD of the illustrated tool holder TH are downwardly-facing surfaces, and the horizontal load-receiving surfaces LR of the illustrated tool are upwardly-facing surfaces. In other embodiments (e.g., where the tool holder is on a lower beam), the horizontal load-delivering surface(s) LD of the tool holder is/are upwardly facing, and the horizontal load-receiving surface (s) of the tool is/are downwardly facing. Thus, the invention provides various combination embodiments wherein the tang T of a tool TL is operatively mounted in the channel C of the tool holder TH such that each load-delivering surface LD of the tool holder is generally or substantially horizontal and is carried directly against a corresponding generally or substantially horizontal load-receiving surface LR of the tool.

In certain embodiments, the tool holder TH is adapted for forcing the tool TL (e.g., when the tool is operatively mounted on the tool holder) against a workpiece by delivering force from the load-delivering surface(s) LD of the tool holder to the load-receiving surface(s) LR of the tool. In preferred embodiments of this nature, the tool holder TH is adapted for moving the operatively-mounted tool TL along a pressing axis PA (e.g., during a pressing operation). For example, the tool holder TH can optionally be adapted for moving the tool TL in a pressing direction PD that is generally or substantially normal to the load-delivering surface(s) LD of the tool holder. In preferred embodiments of this nature, each load-delivering surface LD of the tool holder TH is generally or substantially horizontal, and the tool holder is adapted for moving the tool TL in a generally or substantially vertical direction. Accordingly, the tool holder in these embodiments is adapted for moving the tool vertically into and out of engagement with a workpiece (e.g., when the workpiece is secured in a working position between the upper and lower tables of the press brake).

In some embodiments, the tool holder is operably coupled to a press brake ram that is adapted for moving the tool holder and the operatively-mounted tool together so as to force the workpiece-deforming surface TP of the tool against a workpiece. Preferably, the ram is adapted for moving the tool holder TH and the tool TL together in a pressing direction PD that is generally or substantially normal to the load-delivering surface(s) LD of the tool holder (e.g., in a vertical direction). In other embodiments, the tool holder is not adapted for moving the operatively-mounted tool, but rather is designed for securing the operatively-mounted tool in a static position during pressing operations.

Preferably, the tool holder TH has a closed configuration and an open configuration. When the tool holder TH is in its open configuration, the tang T of a press brake tool TL can be freely moved into and out of the tool holder's channel C. Reference is made to FIGS. 1, 5-7, and 13. When the tool holder TH is in its closed configuration, the tang T of a tool TL mounted in the tool holder's channel C is clamped forcibly (and held rigidly) against a wall CW of the tool holder. Reference is made to FIGS. 2, 3, 8, 12, and 14.

The present tool holder TH includes a driver D. Preferably, the driver D serves as an actuator for the tool holder. That is, the driver D preferably can be operated so as to open and/or close the tool holder. The illustrated embodiments provide a tool holder TH that assumes, or stays in, its closed configuration during any loss of power to the tool holder. Thus, when the driver D is in a non-energized state, the tool holder TH stays in its closed configuration, thereby securely retaining any tools that are mounted on the tool holder.

The illustrated driver D is hydraulic. However, the driver D can alternatively be mechanical, pneumatic, and/or thermally responsive. In certain embodiments, the driver D is a solenoid selected from the group consisting of a hydraulic solenoid, a pneumatic solenoid, and an electrical solenoid.

In one alternate embodiment, the driver D comprises a thermally-responsive actuator of the type described in U.S. patent application Ser. No. 10/876,886, entitled "Thermally-Actuated Press Brake Tool Holder Technology", the entire contents of which are incorporated herein by reference. The hydraulic subassembly shown in drawings of the present disclosure, for example, can optionally be replaced with a reservoir/polymer/heating element subassembly. A subassembly of this nature, for example, can involve a thermally-responsive polymer disposed in a reservoir of the tool holder. Preferably, a piston-like body is in fluid communication with the polymer, and the polymer can be heated (e.g., by operating a heating element in, or adjacent to, the reservoir) so as to cause the polymer in the reservoir to expand and bear forcibly against the piston-like body, thus moving the piston-like body in such a way that the tool holder is actuated (i.e., is opened or closed).

In embodiments where the driver D is hydraulic, the tool holder TH can optionally have a hydraulic subassembly built into the body (e.g., into a block) B of the tool holder. For example, the body of the tool holder can define one or more internal channels and/or recesses in which components of a hydraulic subassembly are mounted. These components can optionally include a hydraulic chamber HC and a wall 50D (which can optionally be part of a cylinder of the driver) that is moveable in response to delivering hydraulic fluid into the chamber HC. Embodiments of this nature are exemplified in FIGS. 12-14.

In other embodiments, the tool holder TH is provided with a hydraulic subassembly that is mounted on a side of the tool holder. In these embodiments, for example, a hydraulic manifold MF can be mounted on a desired side (e.g., optionally on a rear side RS) of the tool holder TH. Embodiments of this nature are exemplified in FIGS. 1-8.

Figure 13:
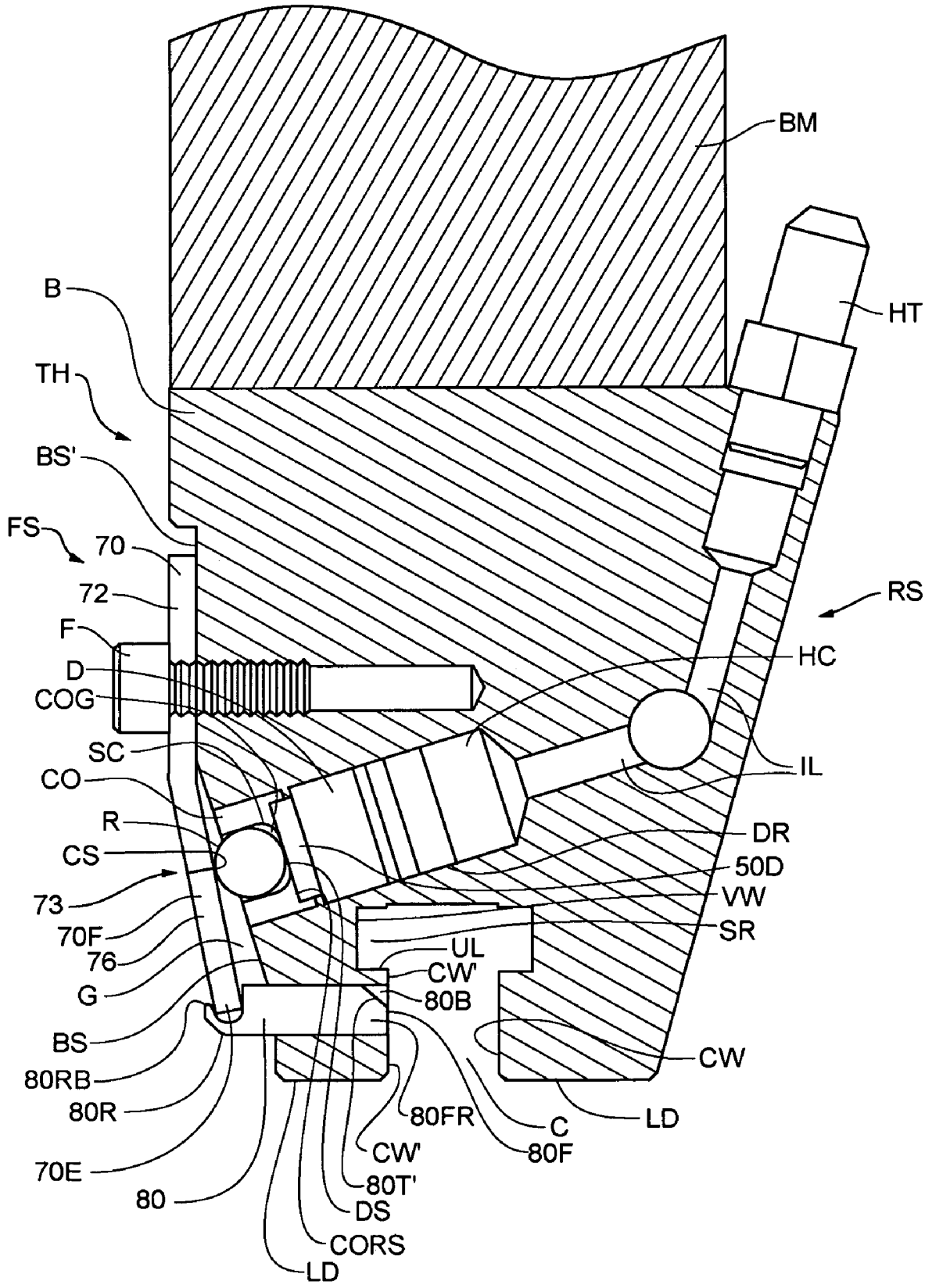
FIG. 13 is a schematic cross-sectional side view of a press brake tool holder in accordance with certain embodiments of the invention.
Figure 14:
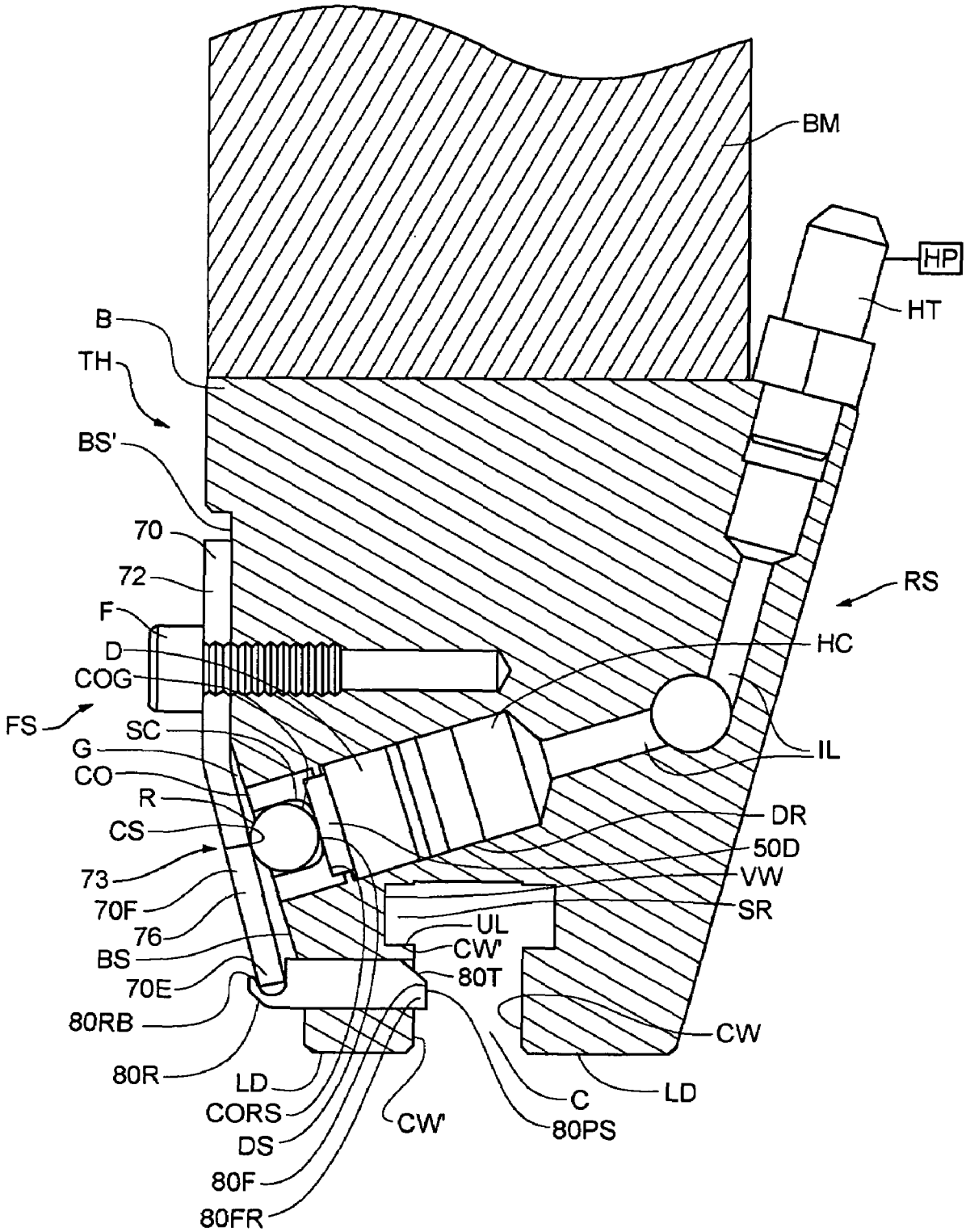
FIG. 14 is a schematic cross-sectional side view of a press brake tool holder in accordance with certain embodiments of the invention.

With reference to FIGS. 12-14, the driver D is mounted in a driver recess DR defined by the body (e.g., a block) B of the tool holder TH. The driver D here is hydraulic and includes a hydraulic chamber HC disposed in the driver recess DR. In the illustrated embodiment, an internal hydraulic line or channel IL extends from the hydraulic chamber HC, through the body B of the tool holder, and to the rear side RS of the tool holder. Alternatively, the positioning can be reversed such that the push plate 70 is on the rear side RS of the tool holder TH, while the internal hydraulic line or channel IL extends to the front side FS of the tool holder. A hydraulic tee fitting HT can optionally be provided to connect the internal hydraulic line or channel IL to an external hydraulic line HL. A wall 50D that is part of, or cooperates with, the driver D is moveable in response to delivering hydraulic fluid into the hydraulic chamber HC. The wall 50B can optionally be part of a cylinder of the driver D. In the embodiment of FIGS. 12-14, the driver D can be operated so as to move the wall 50D forcibly against one or more force-distributing bodies, as will now be described.

The tool holder TH of FIGS. 12-14 exemplifies a group of embodiments wherein at least one rigid (e.g., metal) longitudinally-elongated force-distributing body R is mounted (e.g., slidably) between the driver D and the push plate 70. One or more bodies R of this nature can advantageously be provided to evenly distribute force delivered from the driver D to the push plate 70. In certain embodiments, for example, the force-distributing body R is adapted for receiving force from a plurality of moveable walls 50D that are part of, or cooperate with, the driver D. These walls 50D, for example, can optionally be formed by longitudinally-spaced plungers (e.g., cylinders) of the driver D. Thus, in some embodiments, such moveable walls 50D are adapted for delivering force to the force-distributing body R at longitudinally spaced-apart locales of (e.g., spots on) the force-distributing body R.

In the embodiment of FIGS. 12-14, the force-distributing body R is in direct contact with the push plate 70 (at least when the push plate is in its second configuration). This, however, is not strictly required.

In one group of embodiments, the force-delivery body R has an arcuate (e.g., convex) contact surface CS that is adapted to deliver force to (e.g., by bearing directly against) the push plate 70. This surface CS, for example, can be generally semicircular and/or semi-oval shaped. If so desired, this arcuate surface can be defined by one side of the body R, while a generally opposed side of this body defines a planar surface (e.g., the body R can optionally be a semi-round rod, such as a half-round rod).

In the embodiment of FIGS. 12-14, the force-delivery body R comprises (e.g., is) an elongated rod having a generally-circular cross section. This rod, for example, can be a steel round with a diameter of between about ¼ inch and about ⅜ inch. In other embodiments, the body R has a cross section that is generally square, generally rectangular, generally triangular, otherwise generally polygonal, or irregularly shaped.

With continued reference to FIGS. 12-14, the illustrated force-delivery body R is sandwiched between the push plate 70 and a coupling body CO. Here, the illustrated coupling body CO defines a channel COG in which the force-delivery body R is at least partially received. This is best seen in FIG. 13. Here, the channel COG is bounded (e.g., defined) by a generally semicircular surface SC of the coupling body CO. In particularly preferred embodiments of this nature, the coupling body CO has at least one generally-planar rear surface CORS that is adapted for receiving force from at least one generally-planar surface DS defined by a moveable wall 50D that is part of, or cooperates with, the driver D. The moveable wall 50D, for example, can optionally be part of a cylinder of the driver D.

Turning now to FIGS. 1-8, the illustrated driver D is part of an assembly that includes at least one moveable force-delivery body 50. When provided, the force-delivery body 50 preferably comprises (e.g., is) a rigid body mounted slidably in a bore 50B extending through the body (e.g., a block) B of the tool holder TH. The illustrated force-delivery body 50 is an elongated sliding shaft. This body 50, however, can be provided in many different forms. For example, the body 50 can be a block that is generally rectangular, generally square, generally cylindrical, generally triangular, etc. When provided, the force-delivery body 50 preferably comprises, or consists essentially of, a metal, such as steel.

In FIGS. 1-8, the illustrated force-delivery body 50 is mounted slidably between the push plate 70 and a moveable wall 50D that is part of, or cooperates with, the driver D. The bore 50B in which the force-delivery body 50 is mounted can optionally extend along a bore axis that is generally perpendicular to the tool holder's pressing axis PA. Preferably, the body 50 is mounted in the bore 50B so as to be slidably moveable along the axis of the bore 50B. In more detail, the illustrated force-delivery body 50 is slidable between a retracted position (shown in FIGS. 2 and 3) and an extended position (shown in FIGS. 1, 5, and 6). When the illustrated body 50 is in its extended position, a leading end 50L of the body 50 bears forcibly against the push plate 70. The bore 50B preferably has an outlet BO that opens through a wall (e.g., defined by the body B) of the tool holder. Preferably, this outlet BO is at least partially covered by the push plate 70.

In FIGS. 1-8, the illustrated force-delivery body 50 has generally-opposed leading 50L and trailing 50R ends. Preferably, the trailing end 5OR of the body 50 is adjacent to the driver D, while the leading end 50L of the body 50 is adjacent to the push plate 70. This is characteristic of certain embodiments wherein the driver D comprises a driver subassembly mounted on a side (e.g., optionally on a rear side RS) of the tool holder. In some embodiments of this nature, a driver subassembly is mounted on a rear side RS of the tool holder TH, the push plate 70 is mounted on a front side FS of the tool holder, and the bore 50B extends between the front FS and rear RS sides of the tool holder.

In the embodiments of FIGS. 1-8, the driver D is adapted for urging the force-delivery body 50 against the push plate 70 in response to delivering a hydraulic fluid into a hydraulic chamber HC of the driver. Similarly, in the embodiment of FIGS. 12-14, the driver D is adapted for urging the force-distributing body R against the push plate 70 in response to delivering hydraulic fluid into a hydraulic chamber HC of the driver D. Thus, the driver D preferably includes at least one hydraulic line HL (e.g., Goodyear 10,000 psi line) adapted for delivering hydraulic fluid to the tool holder TH. The hydraulic line HL optionally is connected to the tool holder TH by a hydraulic tee fitting HT, which in turn optionally is connected to an internal hydraulic line/channel IL leading to the hydraulic chamber HC. While the figures depict a hydraulic driver, it is to be understood that the driver D is not required to be hydraulic, as discussed above.

Thus, the tool holder TH preferably includes a push plate 70 to which the driver D is operably coupled. The push plate 70 is mounted on the tool holder TH so as to be moveable between a first configuration and a second configuration. Preferably, the first configuration is a closed configuration (as shown in FIGS. 2, 3, 8, 12, and 14), while the second configuration is an open configuration (as shown in FIGS. 1, 5-7, and 13). The illustrated driver D is adapted for being operated so as to move the push plate 70 from its first configuration to its second configuration. Preferably, the driver D moves the push plate 70 in this manner by transmitting force (either directly or via one or more other bodies 50, CO, R) to the push plate 70.

In preferred embodiments, the push plate 70 is mounted on the tool holder TH so as to be moveable from its first configuration to its second configuration by a deformation (e.g., a bending) of the push plate. In particularly preferred embodiments, the push plate 70 has an anchored side 72 and a free side 76, the anchored side is rigidly secured to the tool holder TH, and the push plate is mounted on the tool holder so as to be moveable from its first configuration to its second configuration by a bending of the push plate in which the free side of the push plate moves generally away from the tool holder (and/or generally away from the tool-mount channel).

In the embodiments of FIGS. 1-8, to open the tool holder, the driver D can be operated so as to drive the force-delivery body 50 forcibly against the push plate 70, such that the free end 76 of the push plate is moved away from the body B of the tool holder. Preferably, this at least allows the rear end 80R of the pusher member 80 to be moved away from the tool-mount channel C (and in combination embodiments, away from the tang T of a tool TL mounted in the channel C). If so desired, the pusher member 80 in such embodiments can be resiliently biased (e.g., by one or more springs) away from the channel C, so that the pusher member automatically moves away from the channel when the push plate 70 moves into its second configuration. Alternatively, the pusher member 80 can simply be mounted for free sliding in the bore 80B. As still another alternative, the push plate 70 and the pusher member 80 can be mechanically linked such that when the push plate moves from its first configuration to its second configuration, the pusher member is forced (e.g., pushed and/or pulled) by the push plate to move from its closed position to its open position. An exemplary mechanical linkage between the push plate 70 and the pusher member 80 is illustrated in FIGS. 12-14.

As shown in FIGS. 1-3, 5-8, and 12-14, the push plate 70 in some embodiments is mounted on a side (e.g., optionally on a front side FS) of the tool holder TH. For example, the tool holder can have generally-opposed sides on one of which the push plate is mounted, and the driver can be a hydraulic driver comprising a hydraulic subassembly that includes a hydraulic line HL leading away from the other side of the tool holder. In the illustrated embodiments, the front FS and rear RS sides of the tool holder TH are generally opposed, the push plate 70 is mounted on the front side FS of the tool holder, and the driver D is a hydraulic driver comprising a hydraulic assembly that includes a hydraulic line HL. The illustrated hydraulic line HL leads away from the rear side RS of the tool holder TH (e.g., to a hydraulic pump HP).

The invention provides one group of embodiments wherein the driver D is operably connected to a hydraulic pump HP. In some of these embodiments, the pump HP is adapted for generating a discharge pressure of between about 2,000 psi and about 5,000 psi. Suitable hydraulic pumps are commercially available from a number of suppliers, such as Enerpac, which maintains a distributorship in Milwaukee, Wis., U.S.A. Some methods of the invention involve operating a hydraulic pump HP so as to generate a discharge pressure of between about 2,000 psi and about 5,000 psi. For example, certain methods provide a driver D that is hydraulic, includes a hydraulic chamber HC and a moveable wall 50D (optionally defined by a cylinder of the driver), and the methods involve operating the hydraulic pump HP at a discharge pressure of between about 2,000 psi and about 5,000 psi (e.g., so as to deliver such pressurized hydraulic fluid into the chamber HC), thereby forcing the wall 50D to move toward the push plate 70. In alternate embodiments, the driver could be set-up so that operating the pump causes the moveable wall to move away from the push plate.

Preferably, the push plate 70 is mounted rigidly on the tool holder TH. In some embodiments, for example, the push plate 70 is mounted rigidly on the tool holder such that the plate 70 is prevented from moving substantially in a direction (e.g., in a vertical direction) parallel to the tool holder's pressing axis PA. In some embodiments, one or more fasteners F (e.g., bolts) are used to rigidly anchor the push plate 70 to the tool holder TH in this fashion. In the illustrated embodiments, for example, it can be appreciated that the push plate 70 is mounted on the tool holder TH such that the plate 70 is prevented from moving substantially in any manner other than by a bending of the plate's free side 76 toward and/or away from the tool holder (e.g., toward and/or away from the tool-mount channel).

Figure 6:
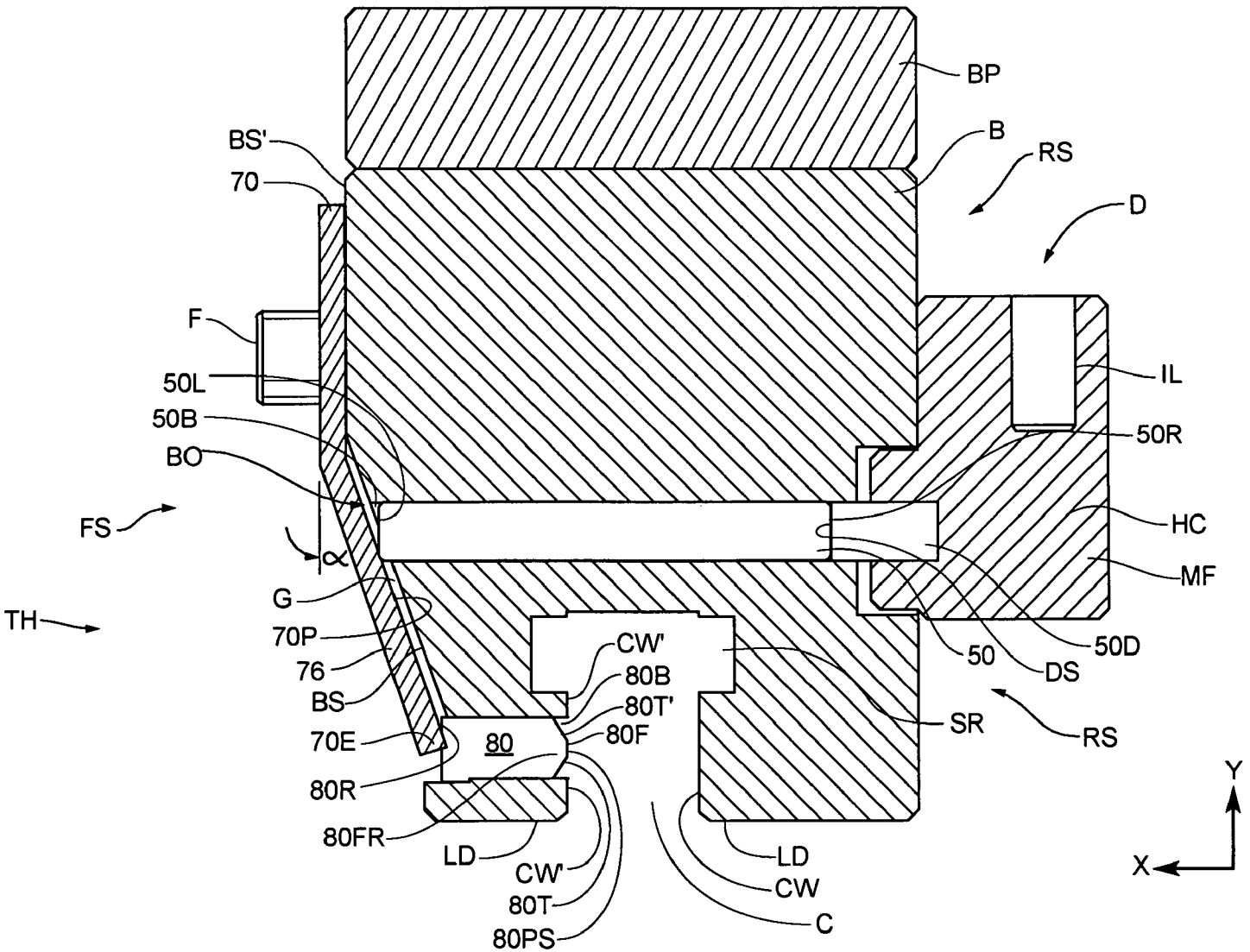
FIG. 6 is a schematic cross-sectional side view of a press brake tool holder in accordance with certain embodiments of the invention.
Figure 7:
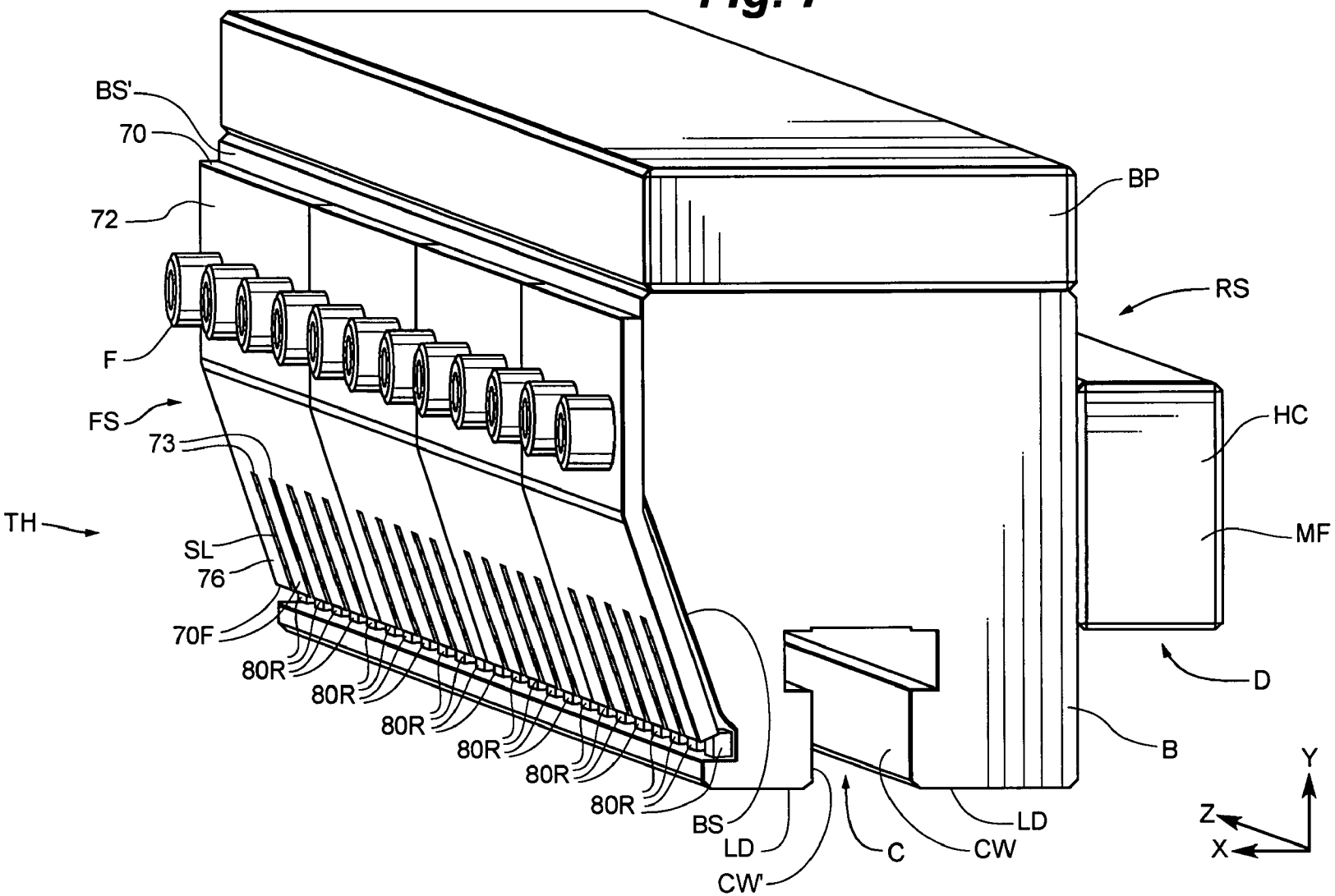
FIG. 7 is a schematic perspective view of a press brake tool holder in accordance with certain embodiments of the invention.

In certain embodiments, the push plate 70 is carried alongside a body (e.g., a block) B of the tool holder TH. For example, a mount portion MP of the push plate 70 can be carried directly against the body B of the tool holder TH. This body B, for example, can be a beam base, optionally embodied as a single block of metal (e.g., steel). In the illustrated embodiments, the body B of the tool holder TH defines two generally-planar (e.g., contiguous) surfaces BS, BS', and the push plate P is carried alongside (though, not necessarily directly against) both of these surfaces. These two surfaces BS, BS' optionally lie in respective planes that are separated by a desired acute angle a, as shown in FIG. 6. In the illustrated embodiments, one BS' of these surfaces is generally vertical, while the other BS is slanted at the angle a relative to the first surface BS'. In some embodiments of this nature, the push plate 70 also defines two generally-planar (e.g., contiguous) surfaces PS, PS' that lie in different planes. In these embodiments, the surfaces PS, PS' preferably lie in respective planes that are separated by an angle that is not more than five degrees different than the angle $\alpha$, and preferably is the same, or substantially the same, as the angle $\alpha$. These features, however, are not required.

In preferred embodiments, the push plate 70 comprises (e.g., is) a resilient plate (e.g., comprising or consisting essentially of metal). The push plate 70, for example, can be formed of steel. In certain particularly preferred embodiments, the push plate is a resilient metal plate comprising a sheet steel. In one particular embodiment, the push plate comprises or consists essentially of a spring steel. Preferably, the plate 70 has a thickness PT of less than about ½ inch, and more preferably less than about ¼ inch, such as about 0.060-0.156 inch. In one particular embodiment, the thickness PT is about 0.120 inch. In certain embodiments, the push plate 70 has a thickness PT that is substantially constant over substantially all (or all) areas of the plate. However, this is not strictly required.

Figure 10:
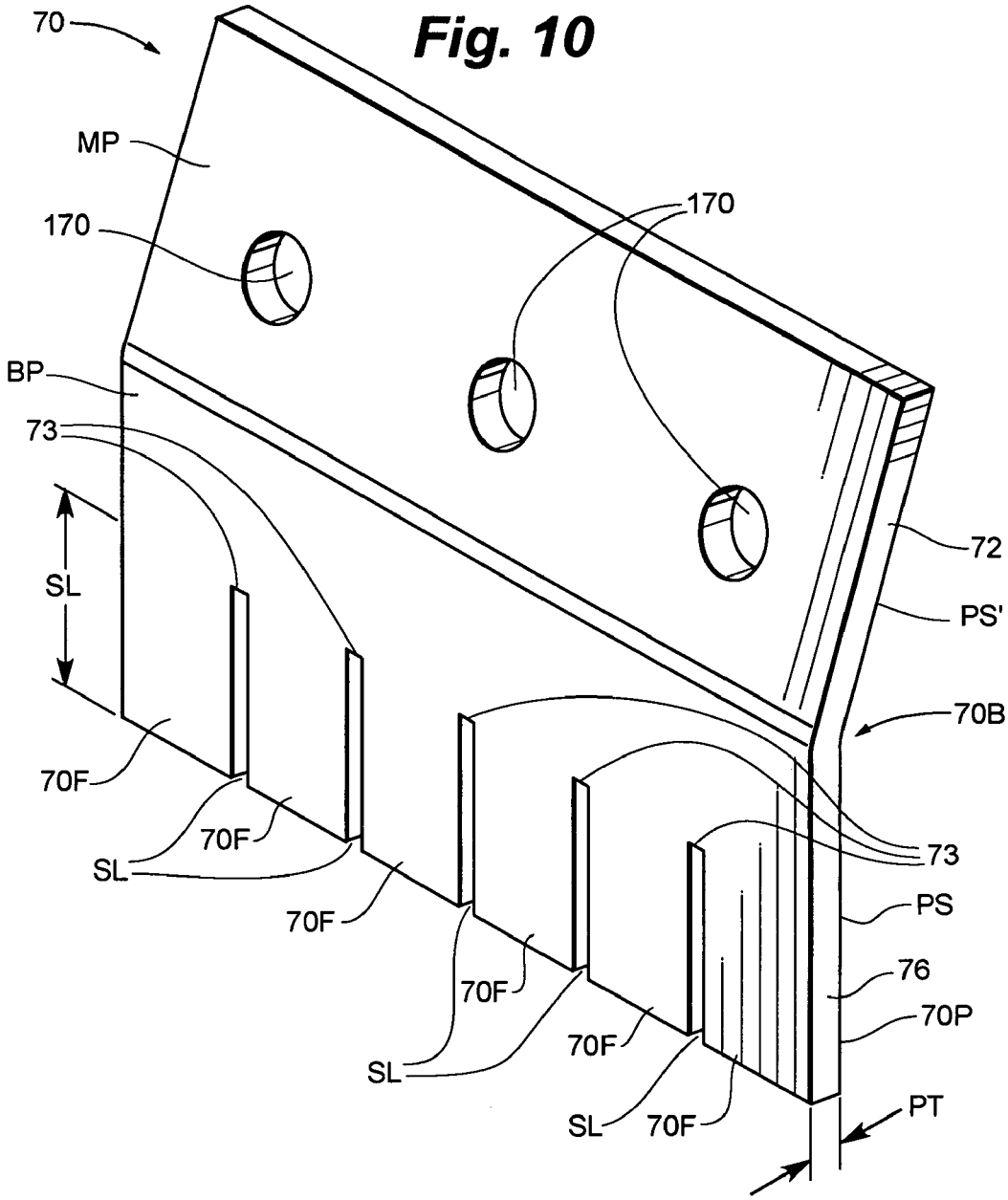
FIG. 10 is a perspective view of a plate member for a press brake tool holder in accordance with certain embodiments of the invention.

FIG. 10 exemplifies one particular push plate 70. Here, the push plate 70 comprises a plurality of force-delivery fingers 70F. The fingers 70F are separated by slits SL, e.g., such that the two fingers of each adjacent pair are separated by a slit SL. Preferably, the push plate 70 includes a plurality of fingers 70F and a plurality of slits SL, each slit extending entirely through a thickness PT of the push plate and being bounded by two of the fingers. In particularly preferred embodiments of this nature, the push plate 70 has an anchored side 72 and a free side 76, the anchored side is rigidly secured to the tool holder TH, and the free side has (e.g., defines) the force-delivery fingers 70F. In the illustrated embodiments, the slits SL all have the same, or substantially the same, length SL. This, however, is by no means required.

In the illustrated embodiments, the push plate has a mount portion MP and a base portion BP. The mount portion MP is adapted for being anchored to a body (e.g., a block) B of the tool holder TH. For example, the mount portion MP of the illustrated push plate 70 defines a plurality of fastener openings 170, as is best seen in FIG. 10. In embodiments of this nature, fasteners (e.g., bolts) F can be extended through respective openings 170 in the push plate 70, so as to rigidly mount the push plate 70 on the tool holder TH, as shown in FIGS. 1-8 and 12-14.

In the illustrated embodiments, the mount portion MP of the push plate 70 and the base portion BP of the push plate are defined by one integral body. That is, the illustrated push plate 70 is of one-piece construction. While this has advantages, it is not required.

Both portions BP, MP of the illustrated plate 70 are generally or substantially planar. As noted above, the base portion BP of the illustrated plate 70 lies in a different plane than the mount portion MP. Preferably, these two portions MP, BP lie in respective planes that are offset by the angle $\alpha$, which preferably is acute. The angle $\alpha$ preferably is at least about 2 degrees, perhaps more preferably is between about 5 degrees and about 40 degrees, and perhaps optimally is between about 10 degrees and about 30 degrees, such as about 20 degrees.

The base BP and mount MP portions of the illustrated push plate 70 extend away from (and come together at) a bend 70B in the plate 70. The bend 70B forms a corner that extends longitudinally along an entire length of the illustrated plate 70. This bend 70B delineates a boundary between the base BP and mount MP portions of the illustrated push plate 70. The force-delivery fingers 70F and slits SL are perpendicular to the bend 70B in the illustrated plate 70. These features, however, are by no means required.

As noted above, the mount portion MP of the illustrated plate P defines a plurality of fastener openings 170. In an alternate embodiment, the fastener openings are provided in the base portion BP of the plate 70. In one particular embodiment, the push plate is entirely planar, such that the base portion BP forms the whole plate.

In certain preferred embodiments, the tool holder TH has the following features: (1) the push plate 70 includes a plurality of force-delivery fingers 70F and a plurality of slits SL, and each slit extends entirely through the thickness PT of the push plate and is bounded by two of the force-delivery fingers; (2) the push plate has an anchored side 72 and a free side 76, the anchored side is rigidly secured to the tool holder TH, and the free side has the force-delivery fingers, and; (3) when the push plate is in its first configuration one (optionally only one) of the force-delivery fingers bears forcibly against the pusher member 80. In some particularly preferred embodiments of this nature, the tool holder TH also has the following features: (4) the push plate 70 has a mount portion MP and a base portion BP, the mount portion defines the anchored side 76 of the push plate and is rigidly secured to the body (e.g., a block) B of the tool holder, the base portion defines the force-delivery fingers 70F, the slits SL do not extend into the mount portion, and; (5) the mount portion, the base portion, and the force-delivery fingers are defined by one integral body. Here, the mount portion MP can optionally lie in a different plane than the base portion BP, as has been described.

Thus, in certain embodiments, the push plate 70 has an anchored side 72 and a free side 76. Preferably, the anchored side 72 is rigidly secured to a body (e.g., a block) B of the tool holder TH. In the illustrated embodiments, the push plate 70 is removably secured to the body B of the tool holder. In other embodiments, the push plate 70 is permanently joined, or integral, to the body B of the tool holder TH. The illustrated push plate 70 and body B are separate bodies.

In particularly preferred embodiments, the free side 76 of the push plate 70 is bent away from the body B of the tool holder TH when the push plate is in its second configuration. The second configuration of the push plate 70 is illustrated FIGS. 1, 5-7, and 13. Here, it can be appreciated that the illustrated push plate 70 is in a loaded, deflected state when in its second configuration. In more detail, when the illustrated push plate 70 is in its second configuration, the free end 70E of the plate 70 is spaced apart from the body B of the tool holder TH. In some cases, the free end 70E of the push plate 70 is also spaced apart from the body B of the tool holder TH when the plate 70 is in its first configuration, but not to the same extent as when the plate 70 is in it second configuration. This is not strictly required. For example, FIGS. 2, 3, and 8 exemplify options for setting-up the tool holder such that when the plate 70 is in its first configuration it 70 is directly against the body B of the tool holder.

Figure 2:
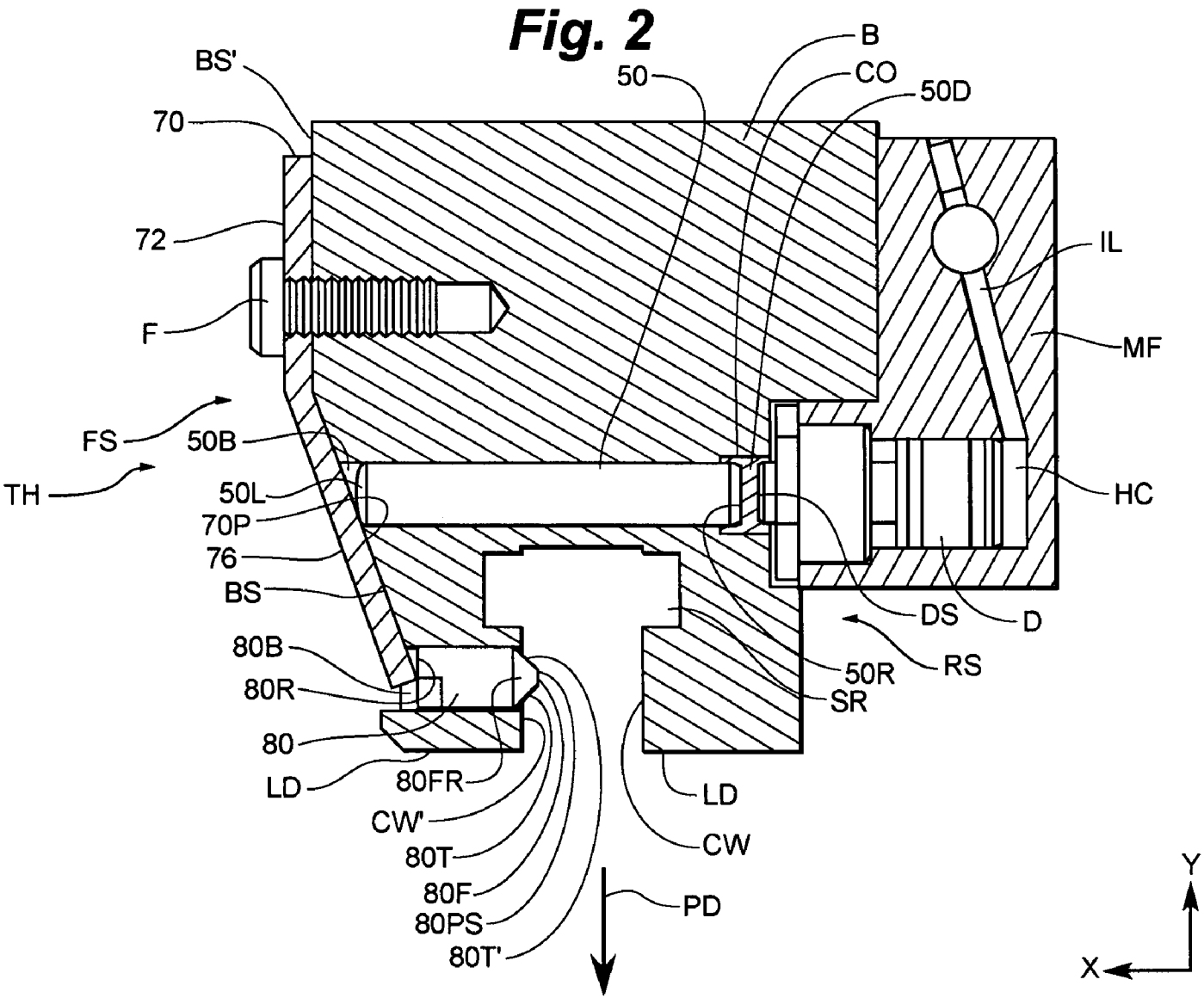
FIG. 2 is a schematic cross-sectional side view of a press brake tool holder in accordance with certain embodiments of the invention.
Figure 8:
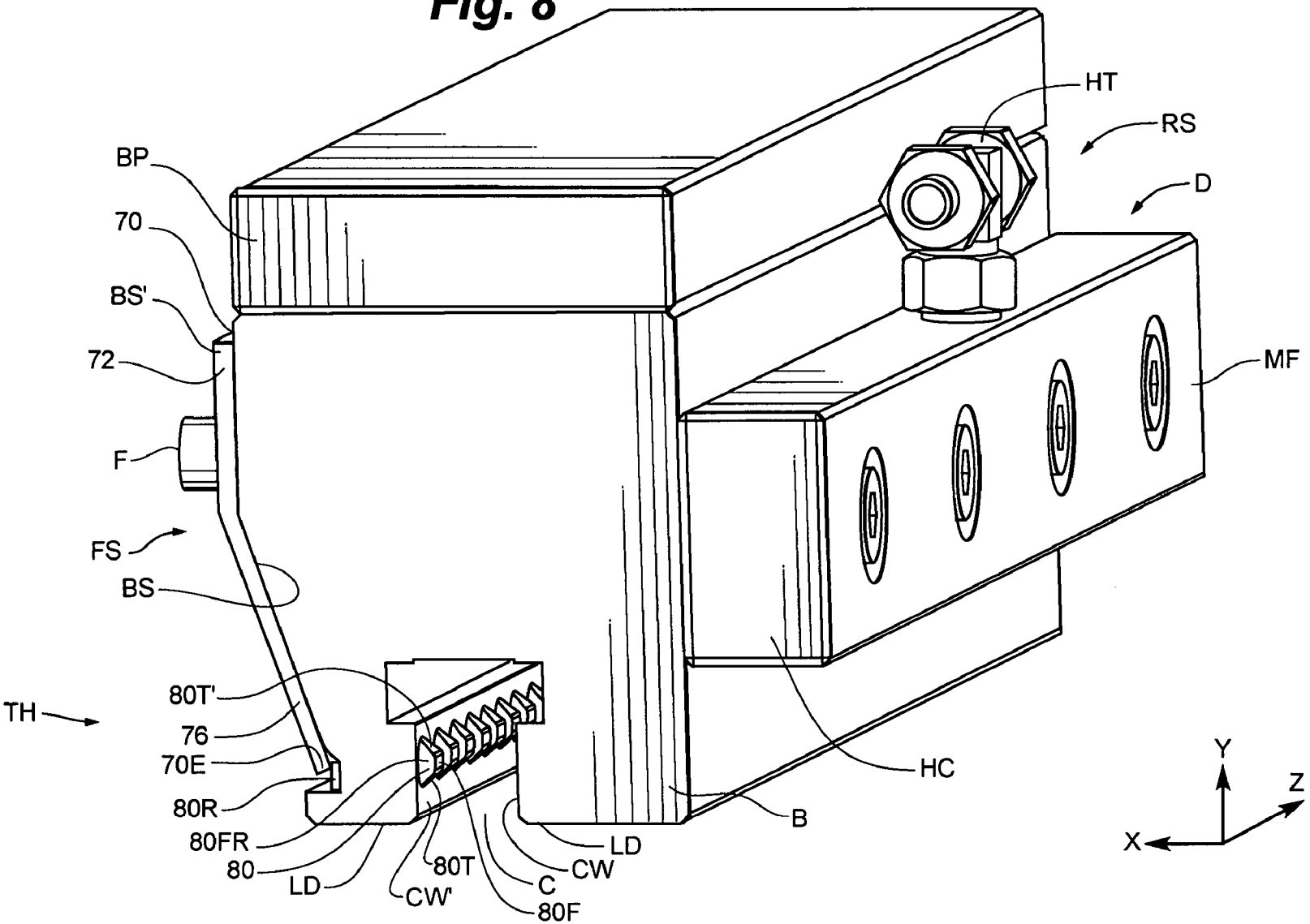
FIG. 8 is a schematic perspective view of a press brake tool holder in accordance with certain embodiments of the invention.

FIGS. 2, 3, and 8 show the free side 76 of the push plate 70 being directly against the body B of the tool holder TH when the push plate is in its first configuration. While this is an option, it is preferred that there be a gap G (whether the push plate is in its first configuration or its second configuration) between the free side 76 of the push plate 70 and the body B of the tool holder TH, such that this gap G has a greater width when the push plate is in its second configuration than when the push plate is in its first configuration. Reference is made to FIGS. 12-14. When the tool holder is set-up in this way (this can also be the case for the tool holder shown in FIGS. 1-8), the push plate 70 when in its first configuration can optionally be in direct contact with a force-distributing body R or a force-delivery body 50.

Thus, in one group of embodiments, either: (i) there exists a gap G between the free side 76 of the push plate 70 and the block B of the tool holder, and this gap G has a lesser width when the push plate is in its first configuration than when the push plate is in its second configuration, or; (ii) the free side 76 of the push plate 70 is carried directly against the block B of the tool holder TH when the push plate is in its first configuration. As noted above, the tool holder TH shown in FIGS. 1-8 can be set-up either way, as can the tool holder TH shown in FIGS. 12-14. In some of these embodiments, the free side 76 of the push plate 70 bears forcibly against the pusher member 80 when the push plate 70 is in its first configuration, as has been described.

Thus, in the illustrated embodiments, the tool holder TH includes at least one pusher member 80. Preferably, the pusher member 80 is mounted on the tool holder TH so as to be moveable between an open position and a closed position. FIGS. 1 and 5-7 illustrate the open position of one exemplary pusher member 80, while FIGS. 2, 3, and 8 illustrate the closed position of this pusher member 80. FIG. 13 illustrates the open position of another exemplary pusher member 80, and FIGS. 12 and 14 illustrate the closed position of this pusher member 80. These figures exemplify a group of embodiments wherein the pusher member 80 is moveable generally or substantially horizontally between its open and closed positions. In FIGS. 1-8 and 12-14, the pusher member 80 is slidably moveable toward and away from the tool-mount channel C. These features, however, are not required.

Preferably, a desired end region (the clamping end region) 80FR of the pusher member 80 extends into the tool-mount channel C when the pusher member is in its closed position. This can be seen in FIGS. 2, 3, 8, 12, and 14. In the illustrated embodiments, the clamping end region 80FR of the pusher member 80 does not project into the channel C when the pusher member 80 is in its open position. Rather, when the illustrated pusher member 80 is in its open position, the clamping end region 80FR of the pusher member 80 is retracted in a bore 80B extending through the body B of the tool holder TH. In certain alternate embodiments, the pusher member extends into the tool-mount channel whether the pusher member is in its closed position or its open position. In these alternate embodiments, the pusher member extends into the channel to a lesser extent when in the open position than when in the closed position.

In the illustrated embodiments, the pusher member 80 is operably coupled with the push plate 70 such that when the push plate 70 is in its first configuration, the pusher member 80 is in its closed position and the push plate 70 provides resistance against the pusher member 80 being moved to its open position. For example, the free side 76 of the illustrated push plate 70 maintains (e.g., forcibly holds) the pusher member 80 in its closed position when the push plate 70 is in its first configuration. In some embodiments, when the push plate 70 is in its first configuration, the free side 76 of the push plate 70 bears forcibly against a rear end 80R of the pusher member 80, which (when a tool TL is operatively mounted in the channel C) is thereby clamped forcibly against the tang T of the tool TL.

As noted above, the driver D preferably can be operated so as to move the push plate 70 into its second configuration. In the illustrated embodiments, when the push plate 70 is in its second configuration, the plate 70 does not prevent the pusher member 80 from being moved to its open position. To the contrary, in the embodiment of FIGS. 12-14, the pusher member 80 moves into its open position in response to moving the push plate 70 to its second configuration. This is accomplished in the embodiment of FIGS. 12-14 by providing a mechanical linkage between the push plate 70 and the pusher member 80 (e.g., between the free end 70E of the push plate 70 and the rear end 80R of the pusher member), as described below.

Preferably, the pusher member 80 comprises (e.g., is) a rigid body having generally-opposed front 80F and rear 80R ends or (sides). In the illustrated embodiments, the pusher member 80 is mounted slidably in a bore 80B extending through a body (e.g., a block) B of the tool holder. This bore 80B, for example, can optionally extend along a bore axis that is generally or substantially perpendicular to the pressing axis PA of the tool holder. This orientation of the bore 50B, however, is by no means required.

In the illustrated embodiments, the pusher member 80 is mounted in the bore 80B so as to be slidably moveable along the axis of the bore 50B. As noted above, this axis can be generally or substantially horizontal, although this is not required. In certain preferred embodiments, the bore 80B opens through one CW' of the generally-confronting (e.g., vertical) walls CW, CW' that bound the tool-mount channel C. Reference is made to FIGS. 1-8 and 12-14.

Thus, the pusher member 80 preferably comprises a rigid body. In some embodiments, this rigid body has a generally-cylindrical configuration. Embodiments of this nature are perhaps best appreciated with reference to FIGS. 4, 8, 9, and 15. It is advantageous, though by no means required, to provide the pusher member 80 with at least one planar side surface 80P. This can facilitate mounting the pusher member 80 in the bore 80B for axial movement without rotation (e.g., so that the pusher member stays in a substantially constant rotational orientation while moving axially in the bore 80B). A tapered surface 80T, 80T' of the pusher member's clamping end region 80FR can thus be maintained in a particular orientation (e.g., in a generally upwardly-facing orientation or in a generally downwardly-facing orientation).

In some embodiments, the pusher member 80 is an elongated sliding pin. Sliding pins of various configurations can be used. In the illustrated embodiments, a generally-cylindrical pin is used. In other embodiments, a generally-rectangular pin is used. Many other pin configurations can be used.

Figure 9:
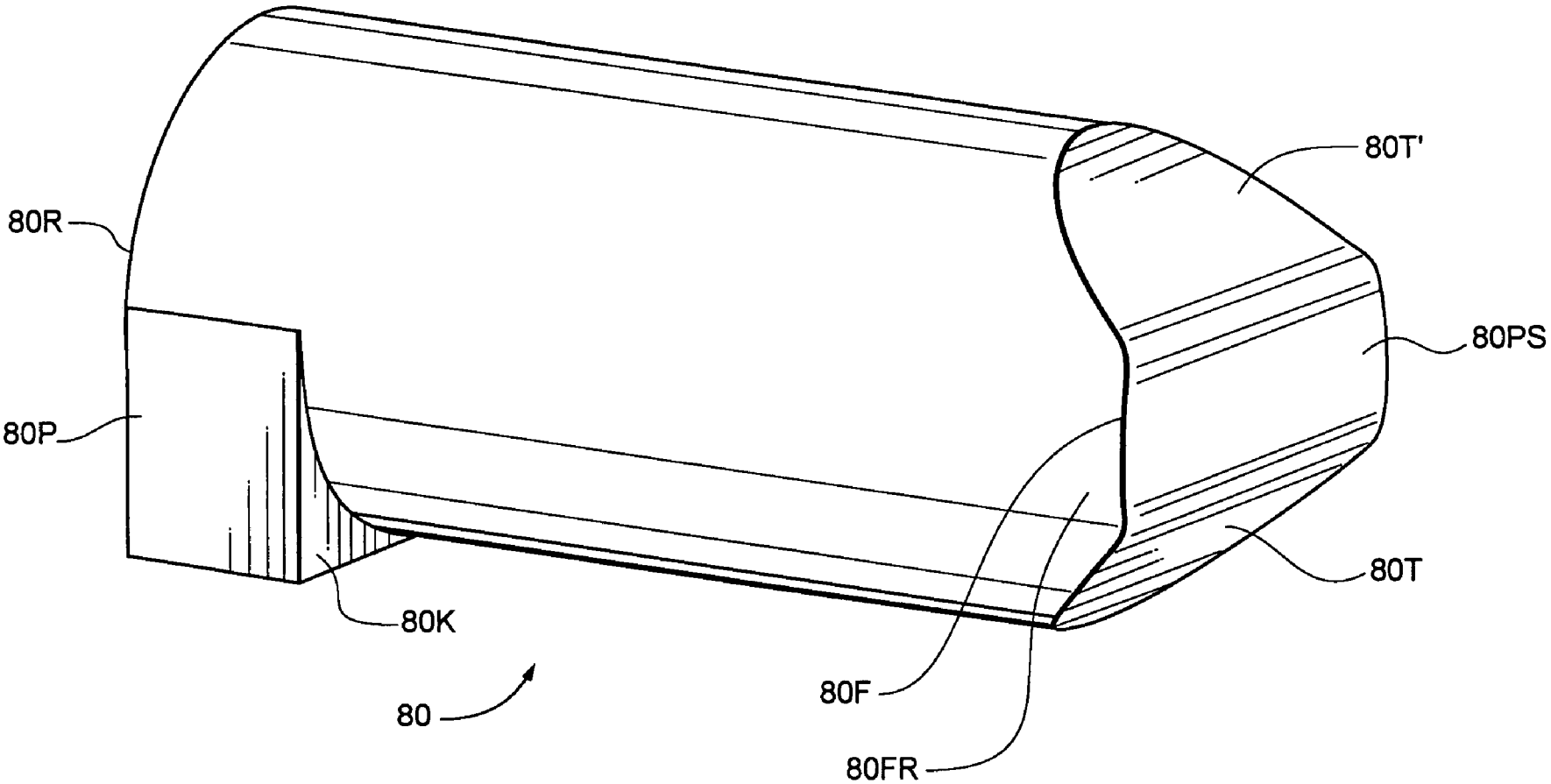
FIG. 9 is a perspective view of a pusher member for a press brake tool holder in accordance with certain embodiments of the invention.
Figure 15:
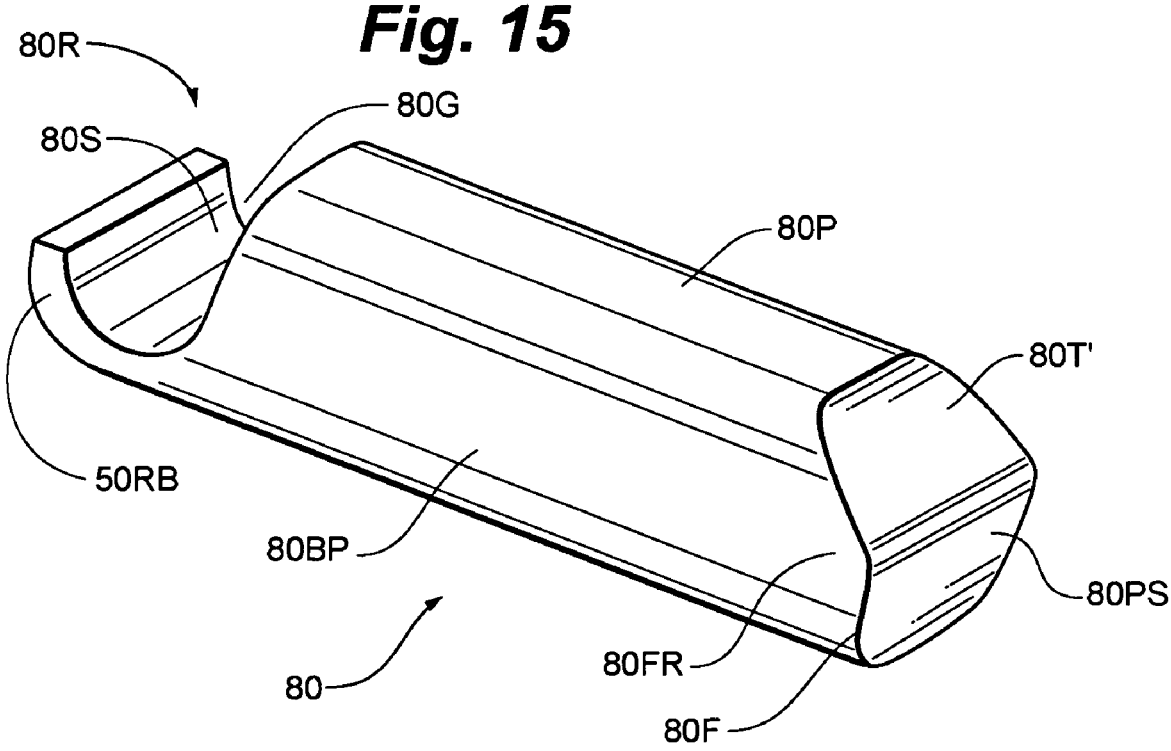
FIG. 15 is a perspective view of a pusher member for a press brake tool holder in accordance with certain embodiments of the invention.

FIGS. 9 and 15 provide detailed illustrations of two exemplary pusher members 80. In both cases, the clamping end region 80FR of the pusher member 80 is tapered. That is, the clamping end region 80FR of each illustrated pusher member 80 defines at least one tapered surface 80T, 80T'. In preferred embodiments of this nature, the clamping end region 80FR of the pusher member 80 also defines at least one planar surface 80PS. This may be advantageous, for example, if the tool holder is used with an American-style tool, or any other tool, that simply has a planar engagement portion EP.

In FIG. 9, the clamping end region 80FR of the illustrated pusher member 80 has upper 80T' and lower 80T tapered surfaces extending respectively away from a planar surface 80PS defined by the leading end 80F of the pusher member 80. In FIG. 15, the clamping end region 80FR of the pusher member 80 only has an upper tapered surface 80T'. In certain alternate embodiments, the clamping end region of the pusher member is not tapered, but the tool holder is provided in combination with a press brake tool the tang of which has an engagement portion with a tapered surface against which the clamping end region of the pusher member is adapted to bear so as to deliver to the tool a clamping force with a seating component that moves the tool so as to bring the load-receiving surface(s) of the tool into direct contact with the load-delivering surface(s) of the tool holder.

Thus, in certain embodiments, the tool holder is adapted (e.g., when a tool is operatively mounted in the channel), for moving the tool along a pressing axis (e.g., during a pressing operation), and the pusher member is adapted for delivering to such an operatively-mounted tool a clamping force having both a seating component and a clamping component. Preferably, the seating component is generally parallel to the pressing axis PA, while the clamping component is generally perpendicular to the pressing axis. For example, the seating component can optionally be generally vertical (and in some cases is an upward force component), while the clamping component is generally horizontal.

As noted above, the pusher member 80 can optionally have a generally-cylindrical configuration. In some embodiments of this nature, the pusher member 80 has at least one cross section (taken along a plane lying in both the Y axis and the Z axis, i.e., in both the vertical axis and the transverse axis) that is not circular, but rather is square, rectangular, triangular, otherwise polygonal, or irregularly shaped. In FIG. 9, for example, the illustrated pusher member 80 has a base portion 80K that is generally square or generally rectangular. A base portion 80K of this nature can optionally be provided as a key that maintains the relative rotational orientation of the pusher member 80 when it slides along the bore 80B. As noted above, this can be useful for maintaining the relative upward or downward orientation of any tapered surface(s) 80T, 80T' of the pusher member 80. Accordingly, the bore 80B in some embodiments has a portion with a non-circular cross section. The shape of the optional base portion 80K can take a variety of different forms. Moreover, in some embodiments, this key-like base portion 80K is eliminated entirely.

With reference to FIGS. 12-14, it can be appreciated that the tool holder TH can optionally be provided with a pusher member 80 that is mechanically linked to the push plate 70. Due to this mechanical linkage, the pusher member 80 moves from its closed position to its open position in response to movement of the push plate 70 from its first configuration to its second configuration. In the embodiment of FIG. 15, the pusher member 80 defines a groove 80G that facilitates the mechanical linkage. Here, the free end 70E of the push plate 70 is received in the groove 80G defined by the pusher member 80. This end 70E of the push plate 70 is retained in the groove 80G at all times during movement of the push plate between its first and second configurations. Thus, the pusher member 80 moves into its closed position in response to the push plate 70 moving to its first configuration, and the pusher member 80 moves into its open configuration in response to the push plate 70 moving to its second configuration.

With reference to FIG. 15, the rear end 80R of the illustrated pusher member 80 has a rib (or "lip") 80RB that projects from a body portion 80BP (which optionally can be generally cylindrical) of the pusher member 80. The illustrated rib 80RB defines a generally C-shaped surface 80S. Preferably, the rib 80RB and the body portion 80BP are integral (i.e., of one-piece construction). This, however, is not strictly required.

As noted above, certain embodiments of the invention provide, in combination, a tool holder and a press brake tool. Here, the tool holder TH has a tool-mount channel C in which a tang of the tool TL is received. In preferred embodiments of this nature, the tool holder includes: (a) a driver D; (b) a push plate 70, and; (c) a pusher member 80. Preferably, the driver D is operably coupled with the push plate 70, as has been described. The push plate 70 is mounted on the tool holder TH, preferably so as to be moveable between a first configuration and a second configuration, as has also been described. In one group of combination embodiments, the push plate 70 is in its first configuration and the driver D is adapted for being operated so as to move the push plate 70 to its second configuration. Preferably, the pusher member 80 is mounted on the tool holder TH so as to be moveable between an open position and a closed position. In the present group of combination embodiments, the pusher member 80 is in its closed position and a clamping end region 80FR of the pusher member 80 bears forcibly against the tang T of the tool TL (e.g., against an engagement portion of the tool's tang). Here, the pusher member 80 is operably coupled with the push plate 70 such that the plate 70 provides resistance against the pusher member being moved to its open position. Preferably, the push plate 70, when in its second configuration, does not prevent the pusher member 80 from being moved to its open position. To the contrary, in some of the present embodiments, the pusher member 80 moves into its open position in response to the push plate 70 being moved to its second configuration.

In certain combination embodiments, the tool holder TH is adapted for moving the tool TL in a pressing direction PD, the pusher member 80 is adapted for delivering a clamping force to the tool, and at least one of the clamping end region 80FR of the pusher member and the engagement portion EP of tool's tang T comprises a tapered surface 80T, 80T', TS, such that the clamping force has a seating component that is generally parallel, and generally opposed, to the pressing direction. The pressing direction, for example, can be a generally vertical downward direction, and the seating force component can be a generally vertical upward force component. Conjointly, the clamping force preferably has a generally horizontal clamping component.

In some combination embodiments, the engagement portion EP of the tool's tang T has a recess R in which the clamping end region 80FR of the pusher member 80 is received when the pusher member 80 is in its closed position. This can be seen in FIGS. 3 and 12.

As noted above, in certain embodiments, the clamping end region 80FR of the pusher member 80 has at least one tapered surface 80T, 80T'. Additionally or alternatively, the engagement portion EP of the tool's tang T can optionally have at least one tapered surface TS against which the clamping end region 80FR of the pusher member 80 is adapted to bear (e.g., forcibly) when the pusher member is moved to its closed position. In FIGS. 1-9, the clamping end region 80FR of the pusher member 80 has upper 80T' and lower 80T tapered surfaces extending respectively away from a planar surface 80PS defined by the leading end 80F of the pusher member 80. In FIGS. 12-15, the clamping end region 80FR of the pusher member 80 has a tapered surface

80T' on one side of the planar surface 80PS, but not on the other side. Thus, in certain embodiments, the clamping end region 80FR of the pusher member 80 has at least one planar surface 80PS and at least one tapered surface 80T, 80T'. This, however, is not strictly required.

In some combination embodiments, the channel C of the tool holder TH includes at least one safety recess (or "safety groove") SR, and the tang T of the tool TL includes a safety key K engaged with the safety recess so as to prevent the tang from falling out of the tool holder's channel C. This is best appreciated with reference to FIG. 3.

The invention also provides various methods involving the tool holder TH. In certain embodiments, there is provided a method of operating a press brake, e.g., by mounting a tool on the press brake. Here, the method comprises: (a) providing a press brake tool holder TH and a press brake tool TL in a combination wherein the tool holder TH has a channel C in which a tang T of the tool TL is received and forcibly clamped. In more detail, the tool holder TH here preferably comprises: (i) a driver D; (ii) a push plate 70 to which the driver is operably coupled, the push plate being mounted on the tool holder so as to be moveable between a first configuration and a second configuration, the push plate being in its first configuration, wherein the driver is adapted for being operated so as to move the push plate to its second configuration by a bending of the push plate; and (iii) a pusher member 80 mounted on the tool holder TH so as to be moveable between an open position and a closed position, the pusher member being in its closed position such that a desired end region 80FR of the pusher member bears forcibly against the tang T of the tool TL so as to deliver a clamping force to the tool, the pusher member being operably coupled with the push plate 70 such that the push plate bears forcibly upon the pusher member and provides resistance against the pusher member being moved to its open position. The present method comprises operating the driver D so as to move the push plate 70 from its first configuration to its second configuration, thereby bending the push plate, thus eliminating or reducing the clamping force.

In certain embodiments, the invention provides a method of closing the tool holder TH. Here, the driver D is operated (e.g., so as to reduce hydraulic pressure in the driver, thereby allowing the moveable wall(s) 50D to retract away from the push plate 70, hence eliminating or reducing a bending force on the push plate) such that the push plate 70 moves from its second configuration to its first configuration. This causes the free side 76 of the push plate 70 to bear forcibly against the rear end 80R of the pusher member 80, which in turn causes the clamping end region 80FR of the pusher member to bear forcibly against an engagement portion EP of the tool TL so as to deliver a clamping force to the tool.

As noted above, the clamping force delivered to the tool TL preferably has a seating component and clamping component. The seating component preferably moves the tool TL so as to bring the load-receiving surface(s) LR of the tool TL into direct contact with the load-delivering surface(s) LD of the tool holder TH. The clamping component preferably forces the tang T of the tool against a wall CW bounding the tool-mount channel C. Preferably, the seating component is generally or substantially parallel to the pressing axis PA, while the clamping component is generally or substantially perpendicular to the pressing axis PA. In particularly preferred embodiments, the seating component is generally or substantially vertical (and in some cases, is an upward force component), while the clamping component is generally or substantially horizontal.

While preferred embodiments of the present invention have been described, it is to be understood that numerous changes, adaptations, and modifications can be made to the preferred embodiments without departing from the spirit of the invention and the scope of the claims. Thus, the invention has been described in connection with specific embodiments for purposes of illustration. The scope of the invention is described in the claims, which are set forth below.

What is claimed is:

1. A tool holder for a press brake, the tool holder having a tool-mount channel configured for receiving a tang of a press brake tool, the tool holder comprising:

a) a driver;

b) a push plate to which the driver is operably coupled, the push plate being mounted on the tool holder so as to be moveable between a first configuration and a second configuration, wherein the driver is adapted for being operated so as to move the push plate from its first configuration to its second configuration; and c) a pusher member mounted on the tool holder so as to be moveable between an open position and a closed position, wherein a desired end region of the pusher member extends into the tool-mount channel when the pusher member is in its closed position, the pusher member being operably coupled with the push plate such that when the push plate is in its first configuration the pusher member is in its closed position and the push plate provides resistance against the pusher member being moved into its open position, and wherein the pusher member comprises a rigid body mounted slidably in a bore extending through a block of the tool holder.

2. The tool holder of claim 1 wherein the push plate is mounted on the tool holder so as to be moveable from its first configuration to its second configuration by a deformation of the push plate.

3. The tool holder of claim 1 wherein the push plate is mounted on the tool holder so as to be moveable from its first configuration to its second configuration by a bending of the push plate.

4. The tool holder of claim 1 wherein the push plate has an anchored side and a free side, the anchored side being rigidly secured to the tool holder, the push plate being mounted on the tool holder so as to be moveable from its first configuration to its second configuration by a bending of the push plate in which the free side of the push plate moves generally away from the tool holder.

5. The tool holder of claim 1 wherein the push plate has an anchored side and a free side, the anchored side being rigidly secured to the tool holder, and when the driver is operated so as to move the push plate from its first configuration to its second configuration the free side of the push plate moves generally away from the tool-mount channel.

6. The tool holder of claim 1 wherein the tool holder is adapted for moving the tool along a pressing axis during a pressing operation, and wherein the push plate is mounted rigidly on the tool holder such that the push plate is prevented from moving substantially in a direction parallel to the pressing axis.

7. The tool holder of claim 1 wherein the push plate is mounted rigidly on the tool holder such that the push plate is prevented from moving substantially in a vertical direction.

8. The tool holder of claim 1 wherein the driver has an energized state and a non-energized state, and when the driver is in its non-energized state the push plate is in its first configuration and bears forcibly against the pusher member.

9. The tool holder of claim 1 wherein the tool holder has generally-opposed front and rear sides, the push plate is mounted on one of said sides of the tool holder, and the driver is a hydraulic driver comprising a hydraulic assembly that includes a hydraulic line extending from the other of said sides of the tool holder.

10. A tool holder for a press brake, the tool holder having a tool-mount channel configured for receiving a tang of a press brake tool, the tool holder comprising:

a) a driver;

b) a push plate to which the driver is operably coupled, the push plate being mounted on the tool holder so as to be moveable between a first configuration and a second configuration, wherein the driver is adapted for being operated so as to move the push plate from its first configuration to its second configuration; and c) a pusher member mounted on the tool holder so as to be moveable between an open position and a closed position, wherein a desired end region of the pusher member extends into the tool-mount channel when the pusher member is in its closed position, the pusher member being operably coupled with the push plate such that when the push plate is in its first configuration the pusher member is in its closed position and the push plate provides resistance against the pusher member being moved into its open position;

wherein the push plate is mounted on the tool holder such that the push plate is carried alongside a block of the tool holder, the block defining two generally-planar surfaces lying in respective planes that are separated by a desired acute angle, wherein the push plate is carried alongside these two surfaces of the block and defines two generally-planar surfaces lying in respective planes that are separated by an angle not more than about five degrees different than said desired acute angle;

and wherein a first of said two generally-planar surfaces defined by the block is generally vertical, and a second of said two generally-planar surfaces defined by the block is slanted at said desired acute angle relative to said first of said two generally-planar surfaces defined by the block.

11. The tool holder of claim 1 wherein the push plate has a thickness that is substantially constant over substantially all areas of the push plate.

12. The tool holder of claim 1 wherein the push plate has a thickness of less than about ¼ inch.

13. The tool holder of claim 12 wherein the thickness is between about 0.060 inch and about 0.156 inch.

14. The tool holder of claim 1 wherein the push plate comprises a resilient metal plate.

15. The tool holder of claim 14 wherein the resilient metal plate comprises a sheet steel.

16. The tool holder of claim 1 wherein the push plate includes a plurality of force-delivery fingers and a plurality of slits, each slit extending entirely through a thickness of the push plate and being bounded by two of the force-delivery fingers.

17. The tool holder of claim 16 wherein the push plate has an anchored side and a free side, the anchored side being rigidly secured to the tool holder, the free side having the force-delivery fingers, and when the push plate is in its first configuration one of the force-delivery fingers bears forcibly against the pusher member.

18. The tool holder of claim 16 wherein the push plate has a mount portion and a base portion, the mount portion being rigidly secured to a block of the tool holder, the base portion defining the force-delivery fingers, wherein the slits do not extend into the mount portion, and wherein the mount portion, the base portion, and the force-delivery fingers are defined by one integral body.

19. The tool holder of claim 18 wherein the mount portion of the push plate lies in a different plane than the base portion of the push plate.

20. The tool holder of claim 1 wherein the push plate has an anchored side and a free side, the anchored side being rigidly secured to a block of the tool holder, and wherein there is a gap between the free side of the push plate and the block of the tool holder and such gap has a lesser width when the push plate is in its first configuration than when the push plate is in its second configuration.

21. The tool holder of claim 20 wherein the free side of the push plate bears forcibly against the pusher member when the push plate is in its first configuration.

22. The tool holder of claim 1 wherein said bore extends along a bore axis that is generally perpendicular to a pressing axis along which the tool holder is adapted for moving the tool during a pressing operation, said rigid body being mounted slidably in said bore so as to be slidably moveable along said bore axis.

23. The tool holder of claim 1 wherein the tool-mount channel is bounded by two generally-confronting walls of the tool holder, and wherein said bore opens through one of said walls.

24. The tool holder of claim 1 wherein said rigid body comprises an elongated sliding pin.

25. The tool holder of claim 1 wherein said desired end region of the pusher member is tapered.

26. The tool holder of claim 25 wherein said desired end region of the pusher member has at least one planar leading surface.

27. The tool holder of claim 1 wherein the pusher member has a generally-cylindrical configuration with at least one planar side surface.

28. The tool holder of claim 1 wherein the tool holder is adapted, when the tool is operatively mounted in the channel, for moving the tool along a pressing axis during a pressing operation, and the pusher member is adapted for delivering to such an operatively-mounted tool a force having both a seating component and a clamping component, the seating component being generally parallel to the pressing axis, the clamping component being generally perpendicular to the pressing axis.

29. The tool holder of claim 1 wherein a bore extending from the driver through a block of the tool holder has an outlet that opens through a wall defined by the block of the tool holder, the push plate being mounted on the tool holder so as to at least partially cover said outlet.

30. The tool holder of claim 1 wherein the driver is a hydraulic driver that is adapted for being operated so as to move the push plate from its first configuration to its second configuration in response to delivering a hydraulic fluid into a chamber of the driver.

31. A tool holder for a press brake, the tool holder having a tool-mount channel configured for receiving a tang of a press brake tool, the tool holder comprising:

a) a driver;

b) a push plate to which the driver is operably coupled, the push plate being mounted on the tool holder so as to be moveable between a first configuration and a second configuration, wherein the driver is adapted for being operated so as to move the push plate from its first configuration to its second configuration; and c) a pusher member mounted on the tool holder so as to be moveable between an open position and a closed position, wherein a desired end region of the pusher member extends into the tool-mount channel when the pusher member is in its closed position, the pusher member being operably coupled with the push plate such that when the push plate is in its first configuration the pusher member is in its closed position and the push plate provides resistance against the pusher member being moved into its open position; and wherein a rigid longitudinally-elongated force-distributing body is mounted between the driver and the push plate.

32. The tool holder of claim 31 wherein the force-distributing body is an elongated rod having a generally-circular cross section.

33. The tool holder of claim 31 wherein the force-distributing body is adapted for receiving force from a plurality of moveable walls that are part of, or cooperate with, the driver.

34. The tool holder of claim 33 wherein the moveable walls are adapted for delivering force to the force-distributing body at respective longitudinally spaced-apart locales of the force-distributing body.

35. The tool holder of claim 31 wherein the force-distributing body is in direct contact with the push plate.

36. The tool holder of claim 32 wherein the force-distributing body is sandwiched between the push plate and a coupling body, the coupling body defining a channel in which the force-distributing body is at least partially received, the channel being bounded by a generally semi-circular surface of the coupling body.

37. The tool holder of claim 36 wherein the coupling body has at least one generally-planar rear surface that is adapted for receiving force from at least one generally-planar surface defined by a moveable wall that is part of, or cooperates with, the driver.

38. The tool holder of claim 1 wherein the push plate includes a plurality of force-delivery fingers and a plurality of slits, each slit extending entirely through a thickness of the push plate and being bounded by two of the force-delivery fingers, wherein one of the force-delivery fingers is adapted for delivering force to the pusher member, wherein a second of the force-delivery fingers is adapted for delivering force to a second pusher member, the second pusher member being mounted on the tool holder for movement between an unlocked position and a locked position, wherein a desired end region of the second pusher member extends into the tool-mount channel when the second pusher member is in its locked position, the second pusher member being operably coupled with the push plate such that when the push plate is in its first configuration the second pusher member is in its locked position and the push plate provides resistance against the second pusher member being moved into its unlocked position.

39. The tool holder of claim 1 wherein the driver comprises a hydraulic assembly including a hydraulic chamber and at least one moveable wall disposed in a recess defined by a block of the tool holder, said wall being moveable in response to delivering hydraulic fluid into said chamber.

40. A tool holder for a press brake, the tool holder having a tool-mount channel configured for receiving a tang of a press brake tool, the tool holder comprising:

a) a driver;

b) a push plate to which the driver is operably coupled, the push plate being mounted on the tool holder so as to be moveable between a first configuration and a second configuration, wherein the driver is adapted for being operated so as to move the push plate from its first configuration to its second configuration; and c) a pusher member mounted on the tool holder so as to be moveable between an open position and a closed position, wherein a desired end region of the pusher member extends into the tool-mount channel when the pusher member is in its closed position, the pusher member being operably coupled with the push plate such that when the push plate is in its first configuration the pusher member is in its closed position and the push plate provides resistance against the pusher member being moved into its open position; and wherein the tool holder includes at least one force-delivery body mounted between the driver and the push plate, the force-delivery body being a rigid body mounted slidably in a bore extending through a block of the tool holder.

41. The tool holder of claim 40 wherein said bore extends along a bore axis that is generally perpendicular to a pressing axis along which the tool holder is adapted for moving the tool during a pressing operation, said rigid body being mounted slidably in said bore so as to be slidably moveable along said bore axis.

42. The tool holder of claim 40 wherein said bore has an outlet that opens through a wall of the tool holder, and the push plate is mounted on the tool holder so as to at least partially cover said outlet.

43. The tool holder of claim 40 wherein said rigid body is slidable between a retracted position and an extended position, said rigid body having a leading end that bears forcibly against the push plate when said rigid body is in its extended position.

44. The tool holder of claim 40 wherein said rigid body is an elongated sliding shaft mounted slidably between the push plate and a moveable wall that is part of, or cooperates with, the driver.

45. A press brake tool holder and a press brake tool, in combination, the tool holder having a tool-mount channel in which a tang of the tool is received, the tool holder comprising:

a) a driver;

b) a push plate to which the driver is operably coupled, the push plate being mounted on the tool holder so as to be moveable between a first configuration and a second configuration, the push plate being in its first configuration, wherein the driver is adapted for being operated so as to move the push plate from its first configuration to its second configuration;

c) a pusher member mounted on the tool holder so as to be moveable between an open position and a closed position, wherein the pusher member is in its closed position and a desired end region of the pusher member bears forcibly against the tang of the tool, the pusher member being operably coupled with the push plate such that the push plate provides resistance against moving the pusher member into its open position; and wherein the pusher member comprises a rigid body mounted slidably in a bore extending through a block of the tool holder, wherein said bore extends in a direction that is generally perpendicular to a pressing axis along which the tool holder is adapted for moving the tool during a pressing operation.

46. The combination of claim 45 wherein the tool holder is adapted for moving the tool along a pressing axis, wherein the pusher member bears against an engagement portion of the tool's tang so as to deliver to the tool a force, wherein at least one of said desired end region of the pusher member and the engagement portion of tool's tang comprises a tapered surface, wherein said force has both a seating component and a clamping component, the seating component being generally parallel to the pressing axis, the clamping component being generally perpendicular to the pressing axis.

47. The combination of claim 46 wherein the clamping component is a generally horizontal force component, and the seating component is a generally vertical force component.

48. The combination of claim 45 wherein the driver has an energized state and a non-energized state, and when the driver is in its non-energized state the push plate is in its first configuration and bears forcibly against the pusher member.

49. The combination of claim 45 wherein the tool holder has generally-opposed front and rear sides, the push plate is mounted on one of said sides of the tool holder, and the driver is a hydraulic driver comprising a hydraulic assembly that includes a hydraulic line extending from the other of said sides of the tool holder.

50. The combination of claim 45 wherein the push plate includes a plurality of force-delivery fingers and a plurality of slits, each slit extending entirely through a thickness of the push plate and being bounded by two of the force-delivery fingers.

51. The combination of claim 50 wherein the push plate has an anchored side and a free side, the anchored side being rigidly secured to the tool holder, the free side having the force-delivery fingers, wherein one of the force-delivery fingers bears forcibly against the pusher member.

52. The combination of claim 50 wherein the push plate has a mount portion and a base portion, the mount portion being rigidly secured to a block of the tool holder, the base portion defining the force-delivery fingers, wherein the slits do not extend into the mount portion, and wherein the mount portion, the base portion, and the force-delivery fingers are defined by one integral body.

53. The combination of claim 45 wherein the push plate is mounted on the tool holder so as to be moveable from its first configuration to its second configuration by a bending of the push plate.

54. The combination of claim 45 wherein the push plate has an anchored side and a free side, the anchored side being rigidly secured to the tool holder, and when the driver is operated so as to move the push plate from its first configuration to its second configuration the free side of the push plate moves generally away from the tool-mount channel.

55. The combination of claim 45 wherein the push plate comprises a resilient metal plate.

56. The combination of claim 45 wherein the pusher member has a generally-cylindrical configuration with at least one planar side surface.

57. The combination of claim 45 wherein the push plate has an anchored side and a free side, the anchored side being rigidly secured to a block of the tool holder, and wherein there is a gap between the free side of the push plate and the block of the tool holder and such gap has a lesser width than when the push plate is in its second configuration.

58. The combination of claim 45 wherein the push plate includes a plurality of force-delivery fingers and a plurality of slits, each slit extending entirely through a thickness of the push plate and being bounded by two of the force-delivery fingers, wherein one of the force-delivery fingers bears forcibly against the pusher member, wherein a second of the force-delivery fingers bears forcibly against a second pusher member, the second pusher member being mounted on the tool holder for movement between an unlocked position and a locked position, the second pusher member being in its locked position and a desired end region of the second pusher member bears forcibly against the tang of the tool.

59. A method of operating a press brake, the method comprising:

a) providing a press brake tool holder and a press brake tool, in combination, the tool holder having a tool-mount channel in which a tang of the tool is received and forcibly clamped, the tool holder comprising:

i. a driver;

ii. a push plate to which the driver is operably coupled, the push plate being mounted on the tool holder so as to be moveable between a first configuration and a second configuration, the push plate being in its first configuration, wherein the driver is adapted for being operated so as to move the push plate from its first configuration to its second configuration by bending the push plate;

iii. a pusher member mounted on the tool holder so as to be moveable between an open position and a closed position, wherein the pusher member is in its closed position and a desired end region of the pusher member bears forcibly against the tang of the tool so as to deliver a clamping force to the tool, the pusher member being operably coupled with the push plate such that the push plate bears forcibly upon the pusher member and provides resistance against moving the pusher member into its open position;

b) operating the driver so as to move the push plate from its first configuration to its second configuration, thereby bending the push plate, thus eliminating or reducing said clamping force;

wherein said movement of the push plate from its first configuration to its second configuration results in the pusher member moving from its closed position to its open position, and wherein the pusher member comprises a rigid body mounted slidably in a bore extending through a block of the tool holder, said bore extending along a bore axis that is generally perpendicular to a pressing axis along which the tool holder is adapted for moving the tool during a pressing operation, and wherein said movement of the pusher member from its closed position to its open position involves said rigid body sliding within said bore along said bore axis.

60. The method of claim 59 wherein the push plate has an anchored side and a free side, the anchored side being rigidly secured to the tool holder, wherein said operating the driver causes the push plate to bend from its first configuration to its second configuration such that the free side of the push plate moves generally away from the tool-mount channel.

61. The method of claim 59 wherein the tool holder is adapted for moving the tool along a pressing axis during a pressing operation, the push plate being mounted rigidly on the tool holder such that said movement of the push plate from its first configuration to its second configuration involves substantially no movement of the push plate in a direction parallel to the pressing axis.

62. The method of claim 59 wherein said movement of the push plate from its first configuration to its second configuration involves substantially no vertical movement of the push plate.

63. The method of claim 59 wherein the driver is a hydraulic driver, and said operating the driver involves delivering hydraulic fluid into a chamber of the driver.

64. The method of claim 63 wherein said hydraulic fluid is delivered into said chamber at a pressure between about 2,000 psi and about 5,000 psi.

65. The method of claim 59 wherein the push plate has an anchored side and a free side, the anchored side being rigidly secured to a block of the tool holder, and wherein there was a gap between the free side of the push plate and the block when the push plate was in its first configuration, and said movement of the push plate involved the free side of the push plate moving further away from the block.

66. The method of claim 59 wherein the push plate includes a plurality of force-delivery fingers and a plurality of slits, each slit extending entirely through a thickness of the push plate and being bounded by two of the force-delivery fingers, and wherein the push plate has a mount portion and a base portion, the mount portion being rigidly secured to a block of the tool holder, the base portion defining the force-delivery fingers, wherein the slits do not extend into the mount portion, and wherein the mount portion, the base portion, and the force-delivery fingers are defined by one integral body.

67. A method of operating a press brake, the method comprising:

a) providing a press brake tool holder and a press brake tool, in combination, the tool holder having a tool-mount channel in which a tang of the tool is received and forcibly clamped, the tool holder comprising:

i. a driver that is hydraulic and includes a hydraulic chamber;

ii. a push plate to which the driver is operably coupled, the push plate being moveable between a first configuration and a second configuration, the push plate being in its first configuration, wherein the driver is adapted for being operated in response to delivering hydraulic fluid into the hydraulic chamber, and wherein the driver can be operated in this manner so as to move the push plate from its first configuration to its second configuration;

iii. a pusher member that is moveable between an open position and a closed position, wherein the pusher member is in its closed position and bears forcibly against the tool so as to deliver a clamping force to the tool, the pusher member being operably coupled with the push plate such that the push plate bears forcibly upon the pusher member and provides resistance against moving the pusher member into its open position, wherein the pusher member comprises a rigid body mounted slidably in a bore extending through a block of the tool holder;

b) delivering hydraulic fluid at a pressure of between about 2,000 psi and about 5,000 psi into the hydraulic chamber, thereby operating the driver so as to move the push plate from its first configuration to its second configuration, thus eliminating or reducing said clamping force.

* * * * *